US010144229B2

(12) United States Patent
Oida et al.

(10) Patent No.: US 10,144,229 B2
(45) Date of Patent: Dec. 4, 2018

(54) TAPE CARTRIDGE

(71) Applicant: SEIKO EPSON CORPORATION, Tokyo (JP)

(72) Inventors: Masahiro Oida, Matsumoto (JP); Hideki Sakano, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/563,866

(22) PCT Filed: Apr. 3, 2015

(86) PCT No.: PCT/JP2015/001909

§ 371 (c)(1),
(2) Date: Oct. 2, 2017

(87) PCT Pub. No.: WO2016/157256

PCT Pub. Date: Oct. 6, 2016

(65) Prior Publication Data

US 2018/0117935 A1 May 3, 2018

(51) Int. Cl.

| | |
|---|---|
| ***B41J 15/04*** | (2006.01) |
| ***B41J 17/32*** | (2006.01) |
| ***B41J 3/407*** | (2006.01) |
| ***B41J 17/36*** | (2006.01) |

(52) U.S. Cl.

CPC ..... *B41J 15/044* (2013.01); *B41J 3/4075* (2013.01); *B41J 17/32* (2013.01); *B41J 17/36* (2013.01)

(58) Field of Classification Search

CPC ..... B41J 15/04; B41J 15/044; B41J 3/4075; B41J 32/00; B41J 3/36; B41J 17/32

See application file for complete search history.

(56) References Cited

FOREIGN PATENT DOCUMENTS

| | | |
|---|---|---|
| JP | 09-039347 A | 2/1997 |
| JP | 3247585 B | 11/2001 |
| JP | 2013-141749 A | 7/2013 |

OTHER PUBLICATIONS

International Search Report dated Jun. 9, 2015 in PCT/JP2015/001909 with English-language translation (2 pgs.).

*Primary Examiner* — Kristal Feggins
(74) *Attorney, Agent, or Firm* — Foley & Lardner LLP

(57) ABSTRACT

The tape cartridge is attached or detached in an attaching and detaching direction to or from the tape printing device including a detecting portion for reading specification information of the tape cartridge from a detected portion by irradiating the detected portion disposed in the tape cartridge with detection light. The tape cartridge includes the detected portion disposed on a wall surface in the attaching and detaching direction; and a fitting portion that is disposed on a wall surface on a rear side in a mounting direction. The detected portion is disposed at a position facing the detecting portion when being mounted.

6 Claims, 25 Drawing Sheets

(a)

(b)

(a)

(b)

(a)

(b)

TAPE CARTRIDGE

TECHNICAL FIELD

The present invention relates to a tape cartridge which is mounted on a cartridge mounting portion of a tape printing device and is used for printing by the tape printing device.

BACKGROUND ART

Conventionally, as a tape printing device (tape writer) in which a tape cartridge is used, a tape printing device including a body case that houses various components, a cartridge mounting portion for detachably mounting a tape cartridge, optical sensors such as a plurality of photointerrupters that are arranged on an inner wall of the cartridge mounting portion, and the like is known (see PTL 1).

A specification display seal for identifying the specification of a printing tape and printing ink in a side surface portion is mounted on the tape cartridge. The plurality of photointerrupters (optical sensors) of the tape printing device are arranged so as to face the specification display seal when the tape cartridge is mounted on the cartridge mounting portion, detect whether or not black ink is printed at a specification display portion formed in the specification display seal, and identify the specification based on the detection result.

CITATION LIST

Patent Literature

PTL 1: Japanese Patent NO. 3247585

SUMMARY OF INVENTION

Technical Problem

However, in the tape printing device of this type, play on manufacturing tolerance is inevitably provided between the tape cartridge and the cartridge mounting portion. As a result, a position of the mounted tape cartridge may be shifted by the tolerance. Thus, a positional relationship between each photointerrupter (optical sensor) and the specification display portion (specification display seal) provided in the tape cartridge is shifted at every time of mounting and there is a problem that the position of the specification display portion is shifted from an optimal position for performing detection by each photointerrupter. Therefore, there is a concern that detection ability by each photointerrupter is lowered and the specification described above cannot be correctly identified.

Solution to Problem

The invention is made to solve at least a part of the above-mentioned problems and can be realized as the following embodiments or application examples.

Application Example 1

A tape cartridge of the application example is a tape cartridge that is attached or detached in an attaching and detaching direction to or from a tape printing device including a detecting portion for reading specification information of the tape cartridge from a detected portion by irradiating the detected portion disposed in the tape cartridge with detection light. The tape cartridge includes the detected portion disposed on a wall surface in the attaching and detaching direction and a fitting portion that is disposed from a wall surface on a rear side in a mounting direction, in which the detected portion is disposed at a position facing the detecting portion when being mounted along the fitting portion.

According to the application example, the tape cartridge is mounted on the tape printing device along the fitting portion and thereby the tape cartridge and a holder are integrated and the position of the detecting portion is positioned with respect to the position of the detected portion. A positional relationship between the detecting portion and the detected portion can be an optimal positional relationship by positioning according to the mounting.

In addition, in a case where the tape cartridge is mounted, the detecting portion is disposed so as to face the detected portion disposed on the wall surface in the mounting direction of the tape cartridge. Therefore, it is possible to shorten a distance between the detected portion and the detecting portion, and it is possible to reduce an influence of a positional shift between the tape cartridge and the holder. That is, it is possible to maintain the optimal positional relationship between the detecting portion and the detected portion. Therefore, it is possible to cause the positional relationship between the detecting portion and the detected portion to be the optimal positional relationship, and to maintain the optimal positional relationship. Thus, it is possible to improve detection ability by the detecting portion and to correctly read specification information of the tape cartridge.

Moreover, the detected portion corresponds to the specification display portion (specification display seal) in the background art described above.

Application Example 2

In the tape cartridge described in the application example, it is preferable that the detected portion include a bit configuration portion.

According to the application example, it is possible to easily configure identification information of the tape cartridge by using the bit configuration portion.

Application Example 3

In the tape cartridge described in the application example, it is preferable that the bit configuration portion be disposed in a matrix form.

According to the application example, it is possible to configure a large amount of the identification information of the tape cartridge in a limited space by disposing the bit configuration portion in the matrix form.

Application Example 4

In the tape cartridge described in the application example, it is preferable that the detected portion constitute the specification information by a combination of an identification portions disposed in the bit configuration portion.

According to the application example, it is possible to easily configure a large amount of the identification information of the tape cartridge in a limited space by configuring the specification information of the tape cartridge by the combination of the identification portions disposed in the bit configuration portion.

Application Example 5

In the tape cartridge described in the application example, it is preferable that the detected portion be adhered on the wall surface.

According to the application example, it is possible to form the detected portion using, for example, adhesive seal, or the like and it is possible to easily dispose the detected portion on the wall surface.

Application Example 6

In the tape cartridge described in the application example, it is preferable that the detected portion be drawn on the wall surface.

According to the application example, it is possible to directly form the detected portion on the wall surface and to reduce the cost by reducing the number of components, the number of steps such as adhering, or the like.

DESCRIPTION OF EMBODIMENTS

Hereinafter, a tape cartridge according to an embodiment of the invention will be described with reference to the drawings together with a tape printing device on which the tape cartridge is mounted. The tape printing device is provided to create a label (tape piece) by performing printing while feeding a printing tape and an ink ribbon from the mounted tape cartridge and cutting a printed portion of the printing tape.

[Overview of Tape Printing Device]

Figure 1:
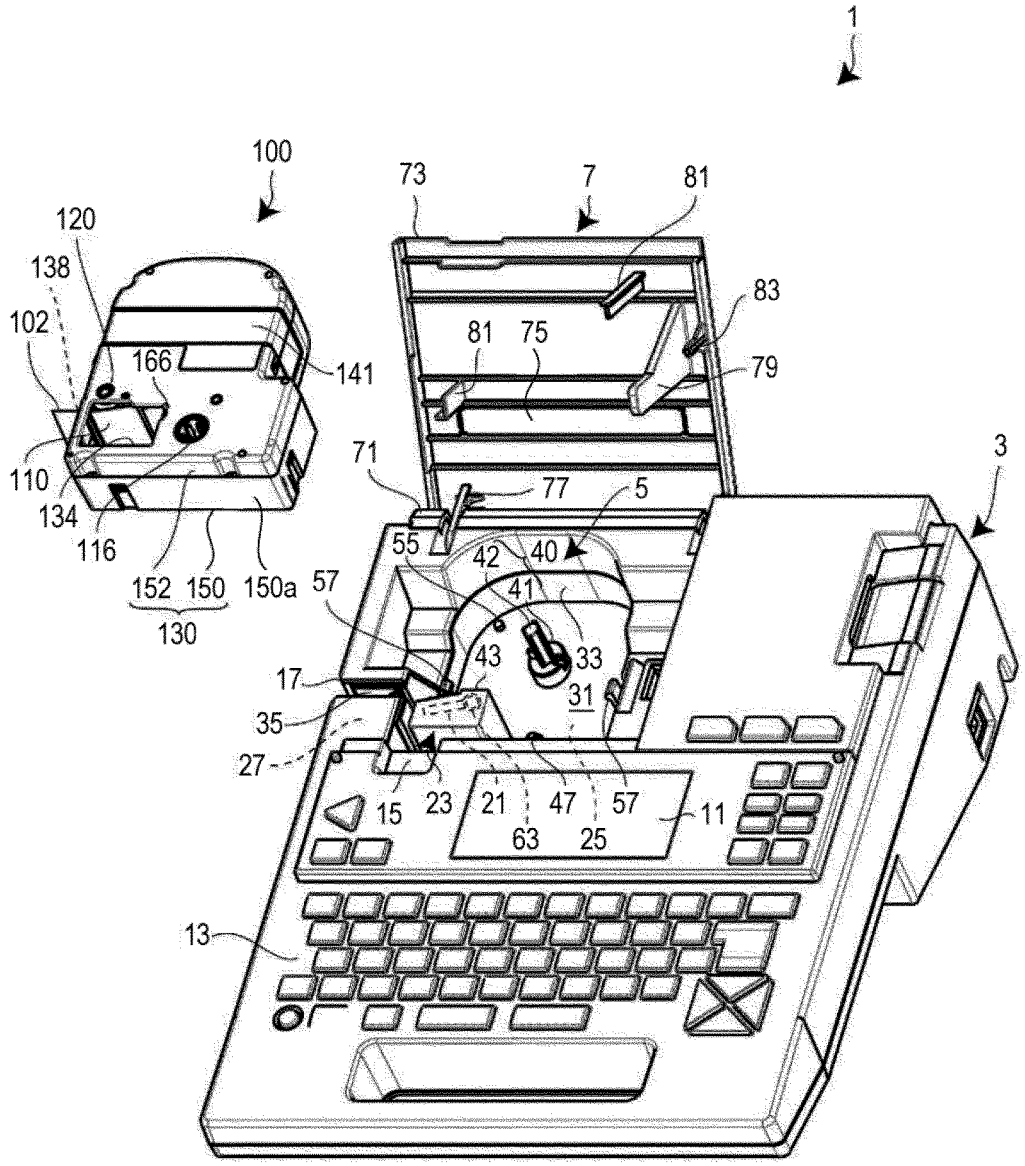
FIG. 1 is an external perspective view of a lid opening state of a tape printing device according to an embodiment.

FIG. 1 is an external perspective view of the tape printing device and the tape cartridge mounted on the tape printing device. As illustrated in the view, a tape printing device 1 includes a device case 3 configuring an outer shell, a cartridge mounting portion 5 on which a tape cartridge 100 is detachably mounted, and an opening and closing lid 7 that opens and closes the cartridge mounting portion 5. The cartridge mounting portion 5 is provided on a rear side, a display 11 is provided in the center, and a keyboard 13 is provided on a front side on an upper surface of the device case 3. A finger hooking recessed portion 15 is provided in the vicinity of the opening and closing lid 7 and the opening and closing lid 7 is opened so as to flip up through the recessed portion 15. Then, an elongated tape discharge port 17 from which a printing tape 102 is discharged is provided on a side surface (left side surface) of the device case 3.

In addition, the tape printing device 1 includes a printing mechanism portion 23 that has a printing head 21 provided uprightly in the cartridge mounting portion 5, a tape feeding mechanism portion 25 that is built in a rear space of the cartridge mounting portion 5, and a tape cutting mechanism portion 27 that is built in the vicinity of the tape discharge port 17.

A user inputs printing information from the keyboard 13, recognizes printing information in the display 11, and then executes printing with a key operation. If printing is commanded, the tape feeding mechanism portion 25 is driven and thereby the printing tape 102 and an ink ribbon 110 run in parallel, and printing is performed therein by thermal transfer by the printing mechanism portion 23. The printing tape 102 is discharged from the tape discharge port 17 by print feeding and if printing is completed, the tape cutting mechanism portion 27 is driven and thereby a printed portion of the printing tape 102 is cut.

[Overview of Tape Cartridge]

Figure 2:
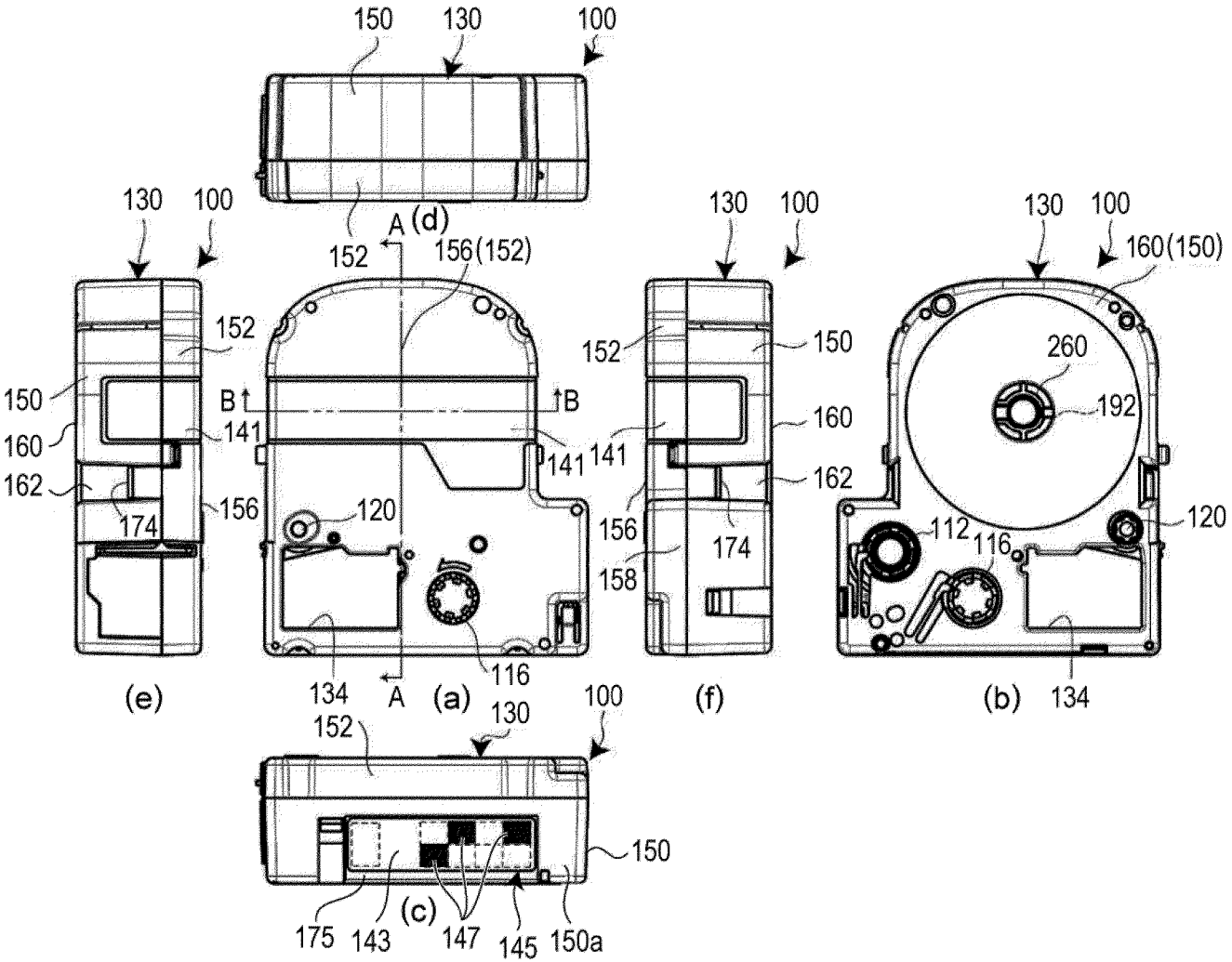
FIG. 2(*a*) is a plan view, 2(*b*) is a rear view, 2(*c*) is a front view, 2(*d*) is a back view, 2(*e*) is a left side view, and 2(*f*) is a right side view of a tape cartridge according to the embodiment.
Figure 9:
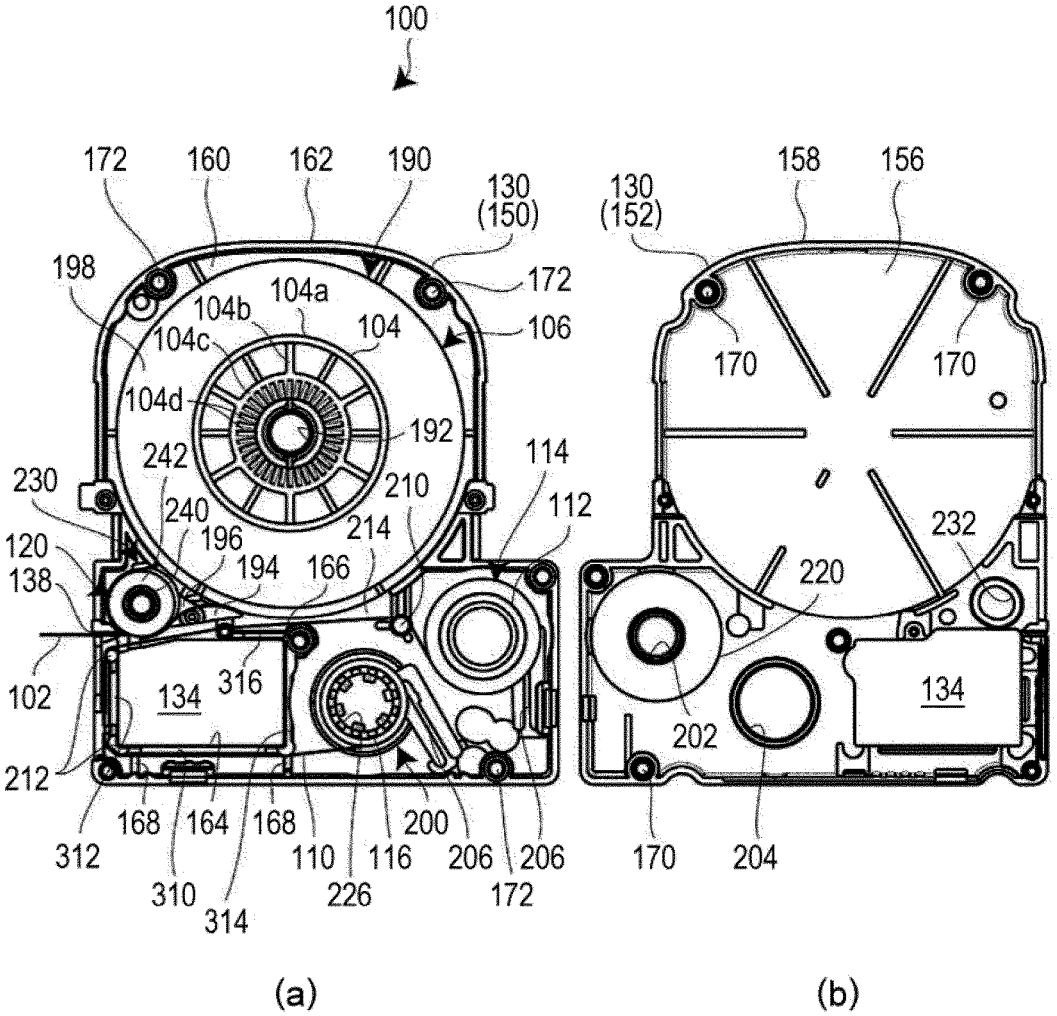
FIG. 9(*a*) is a plan view of an upper case and the tape cartridge in a state where the upper case is removed and 9(*b*) is a rear view of the upper case.

As illustrated in FIGS. 2 and 9, the tape cartridge 100 includes a tape roll 106 that winds the printing tape 102 into a tape core 104 and a ribbon roll 114 that winds the ink ribbon 110 into a feeding core 112. In addition, the tape cartridge 100 includes a winding core 116 that winds the ink ribbon 110 after use and a platen roller 120 (platen) against which the printing head 21 abuts via the ink ribbon 110 and the printing tape 102, and which delivers the printing tape 102 and the ink ribbon 110. Furthermore, the tape cartridge 100 includes a cartridge case 130 that houses the tape roll 106, the ribbon roll 114, the winding core 116, and the platen roller 120. As described above, the tape cartridge 100 of the embodiment has a so-called shell structure in which an outer shell is covered by the cartridge case 130.

In addition, when the tape cartridge 100 is mounted on the tape printing device 1, an insertion opening 134 into which the printing head 21 is inserted is formed in the cartridge case 130 in the tape cartridge 100. In addition, the tape cartridge 100 includes a tape feeding port 138 which is formed in the cartridge case 130 and from which the printing tape 102 is fed. Moreover, the tape roll 106, which is described later in detail, is rotatably supported on a cylindrical core shaft 192 protruding from the inside of the cartridge case 130 (see FIG. 4).

If the platen roller 120 and the winding core 116 are driven by the tape feeding mechanism portion 25 described above, the printing tape 102 is fed from the tape core 104 and the ink ribbon 110 is fed from the feeding core 112. The printing tape 102 and the ink ribbon 110, which are fed, run in parallel in a portion of the platen roller 120 and are subjected to printing by the printing head 21. A feeding end portion (printed portion) of the printing tape 102, in which printing is performed, is fed from the tape feeding port 138 to the tape discharge port 17. On the other hand, the ink ribbon 110 rotates around a peripheral wall portion of the insertion opening 134 and is wound on the winding core 116. Moreover, a plurality of specifications of printing tapes having different thicknesses according to a tape width of the printing tape 102 are prepared in the tape cartridge 100.

[Details of Tape Printing Device]

Figure 5:
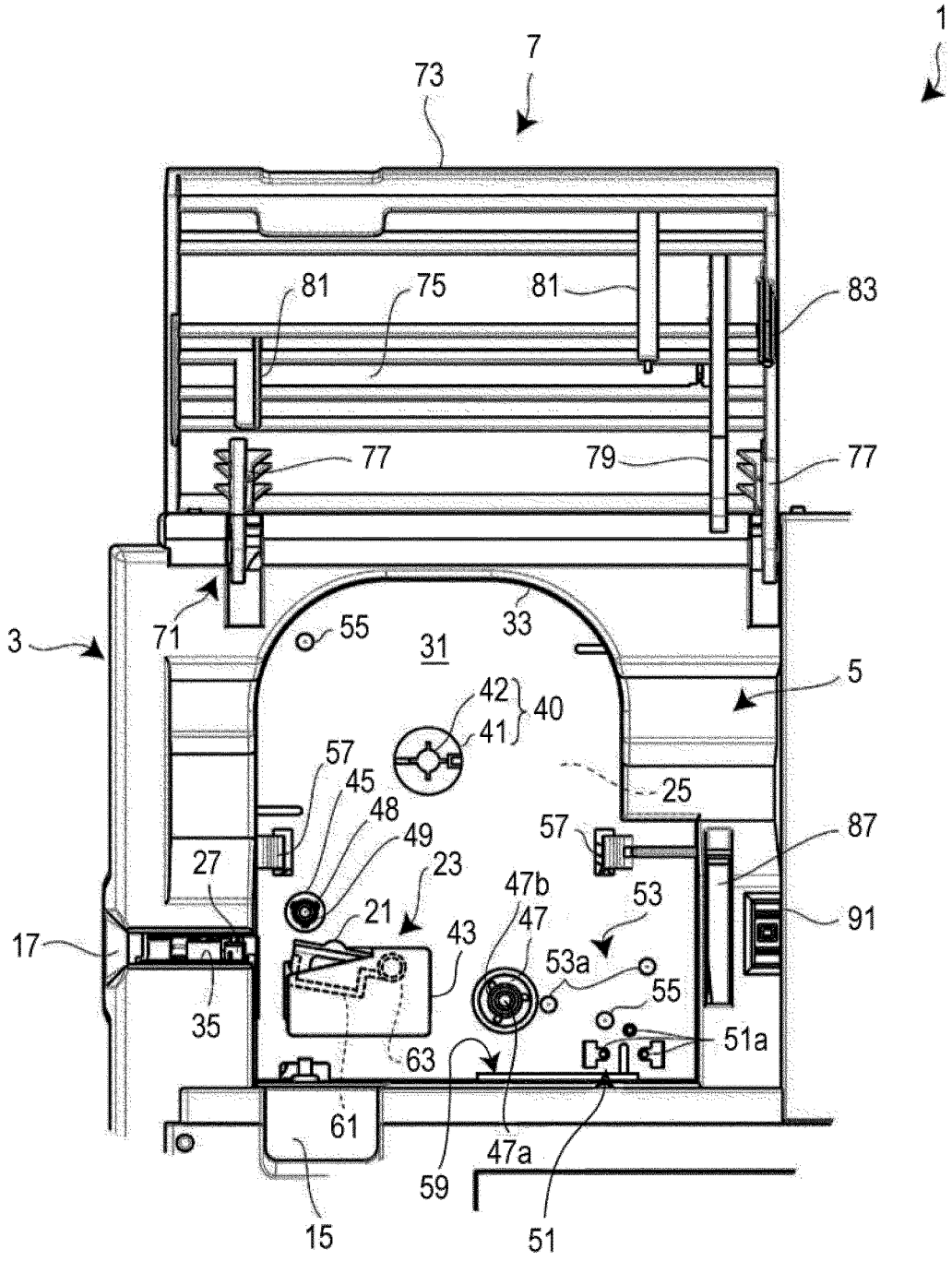
FIG. 5 is a plan view illustrating a cartridge mounting portion of the tape printing device.

As illustrated in FIGS. 1 and 5, the cartridge mounting portion 5 is formed in a complementary planar shape with a planar shape of the tape cartridge 100 and is formed in a recessed shape having a depth corresponding to the tape cartridge 100 of the maximum thickness among a plurality of specifications of tape cartridges 100 which are mountable. In this case, a mounting base 31 configuring a bottom plate portion of the cartridge mounting portion 5 and a side plate portion 33 are integrally formed (molding) of resin and the like. A slit-shaped tape discharge path 35 is formed between the cartridge mounting portion 5 and the tape discharge port 17, and the tape cutting mechanism portion 27 is built into the portion.

In the mounting base 31 of the cartridge mounting portion 5, the base convex portion 40 is provided uprightly as an identification unit into which an inner periphery portion of the core shaft 192 (see FIG. 4) of the tape cartridge 100 is fitted when the tape cartridge 100 is mounted. The base convex portion 40, which is described in detail later, has a circular pedestal portion 41 which is provided uprightly on the mounting base 31 and an identification convex portion 42 which is provided uprightly on the pedestal portion 41.

In addition, the printing head 21 which is covered by a head cover 43, a platen driving shaft 45 which drives the platen roller 120 to rotate, and a winding driving shaft 47 which drives the winding core 116 to rotate are provided uprightly in the mounting base 31. In addition, a tape detecting portion 51 which detects a tape specification (attribute information) of the printing tape 102 and a core release portion 53 which releases rotation stoppers of the feeding core 112 and the winding core 116 are provided in positions in the vicinity of the winding driving shaft 47 in the mounting base 31.

Furthermore, a pair of small protrusions 55 is provided at diagonal positions and a pair of latch pieces 57 for latching a center portion of the mounted tape cartridge 100 is provided in the mounting base 31. On the other hand, the tape feeding mechanism portion 25 configured of a motor and a gear train (both not illustrated) for rotating the platen driving shaft 45 and the winding driving shaft 47 is built into a rear space of the mounting base 31. The tape feeding mechanism portion 25 is power-branched in the gear train and synchronously rotates the platen driving shaft 45 and the winding driving shaft 47.

On the other hand, a pattern reading portion 59 as a detecting portion for reading a bit pattern (specification reading pattern) of a specification reading seal 143 as a detected portion provided on a side surface of the tape cartridge 100 is disposed in the side plate portion 33 (front side) of the cartridge mounting portion 5. In the embodiment, the tape detecting portion 51 detects (recognizes) the tape width of the printing tape 102 housed in the tape cartridge 100 and the pattern reading portion 59 recognizes specification information (tape color and material of the housed printing tape 102, and ribbon color of the housed ink ribbon 110, and the like) of the tape cartridge 100 except the tape width. Details of the pattern reading portion 59 and the bit pattern (specification reading pattern) of the specification reading seal 143 will be described later.

The printing mechanism portion 23 has the printing head 21 configured of a thermal head, a head support frame 61 that is rotated while supplying the printing head 21, a head release mechanism (not illustrated) that rotates the printing head 21 via the head support frame 61 between a printing position and a retracted position, and the head cover 43 that covers the printing head 21 (and the head support frame 61).

The head release mechanism is operated in conjunction with opening and closing of the opening and closing lid 7, and moves (rotates) the printing head 21 to the printing position in conjunction with a closing operation of the opening and closing lid 7, and moves (rotates) the printing head 21 to the retracted position in conjunction with the opening operation. The printing head 21 moved to the printing position abuts against the platen roller 120 of the tape cartridge 100 via the ink ribbon 110 and the printing tape 102, and the printing head 21 moved to the retracted position is separated from the platen roller 120. Therefore, when the tape cartridge 100 is attached or detached, interference of the printing tape 102 and the ink ribbon 110 with the printing head 21 is prevented.

A plurality of heat generating elements are provided in the printing head 21 and the plurality of heat generating elements are arranged in parallel in the same direction as an axial direction of the platen roller 120. Then, printing is performed by delivery of the printing tape 102 and the ink ribbon 110, and selective driving of the plurality of heat generating elements. The head cover 43 is formed in a substantially rectangular shape in a plan view and is formed (molded) integrally with the mounting base 31 (cartridge mounting portion 5). In addition, the head cover 43 vertically protrudes from the mounting base 31 and allows the rotation of the printing head 21 on the inside thereof.

The tape detecting portion 51 is configured of a plurality of micro switches 51*a*, selectively engages with a detected portion 180 (see FIG. 3) of the tape cartridge 100 described below, and detects specifications of the tapes such as the tape width, the tape color, a material of the printing tape 102, and the like. Driving of the printing head 21 or the tape feeding mechanism portion 25 is controlled based on the detection result.

The core release portion 53 is configured of two release pins 53*a* for the feeding core 112 and the winding core 116. Although details will be described later, a rotation stopper hook 206 for latching each of the feeding core 112 and the winding core 116 is provided in the cartridge case 130 (see FIG. 9). If the tape cartridge 100 is mounted, the release pin 53*a* is engaged with the rotation stopper hook 206 and the rotation stoppers of the feeding core 112 and the winding core 116 are released.

Figure 10:
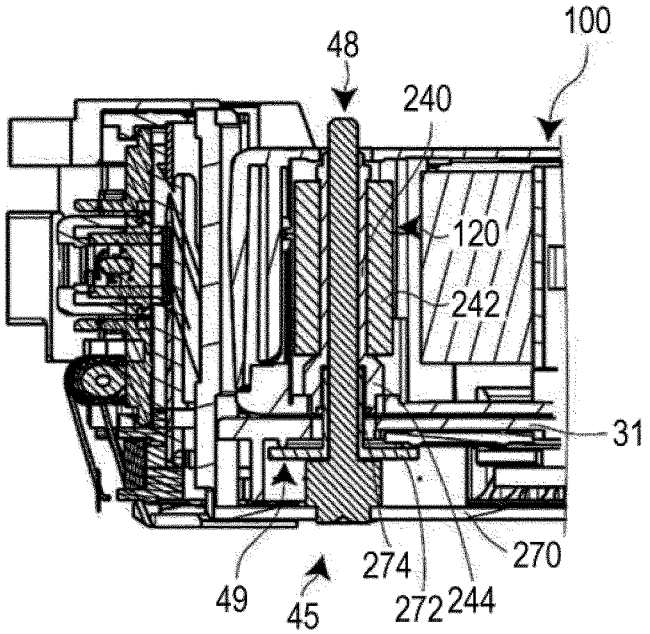
FIG. 10(*a*) is an enlarged sectional view of a platen driving shaft and a platen roller and 10(*b*) is an enlarged view of a spline engagement portion thereof.
Figure 10:
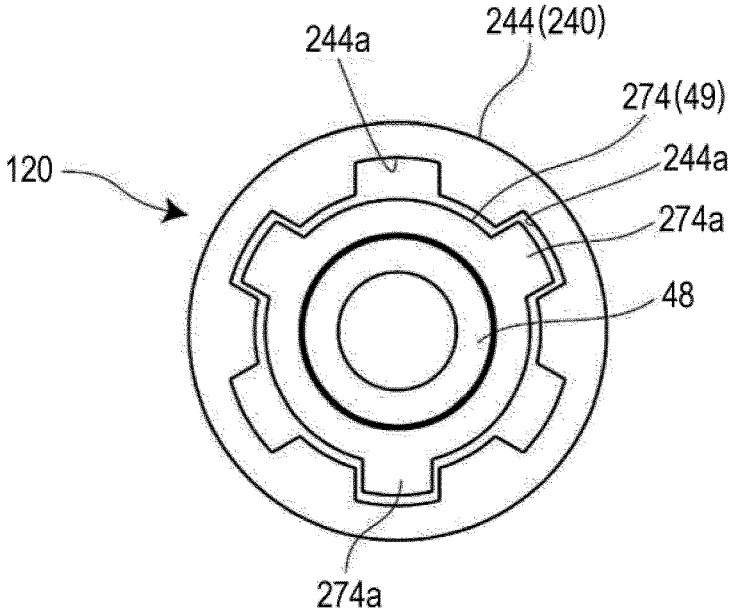

The platen driving shaft 45 has a fixed support shaft 48 provided so as to pass through the platen roller 120 and a spline-shaped spline driving shaft 49 (driving shaft) rotatably journaled on a base portion of the fixed support shaft 48 (see FIGS. 5 and 10). Rotational power of the tape feeding mechanism portion 25 is transmitted to the spline driving shaft 49 and is further transmitted from the spline driving shaft 49 to the platen roller 120 (details will be described later).

Similarly, the winding driving shaft 47 has a fixed shaft 47*a* and a spline-shaped movable shaft 47*b* rotatably journaled on the fixed shaft 47*a*. Also, in this case, rotational power of the tape feeding mechanism portion 25 is transmitted to the movable shaft 47*b* and is further transmitted from the movable shaft 47*b* to the winding core 116.

If the tape cartridge 100 is mounted on the cartridge mounting portion 5, the core shaft 192 (core concave portion 260 which is described below) is engaged with the base convex portion 40 (see FIG. 13), the platen roller 120 is engaged with the platen driving shaft 45, and the winding core 116 is further engaged with the winding driving shaft 47. Then, if the opening and closing lid 7 is closed, the printing head 21 is rotated and abuts against the platen roller 120 to interpose the printing tape 102 and the ink ribbon 110 therebetween, and the tape printing device 1 is in a printing standby state.

Figure 8:
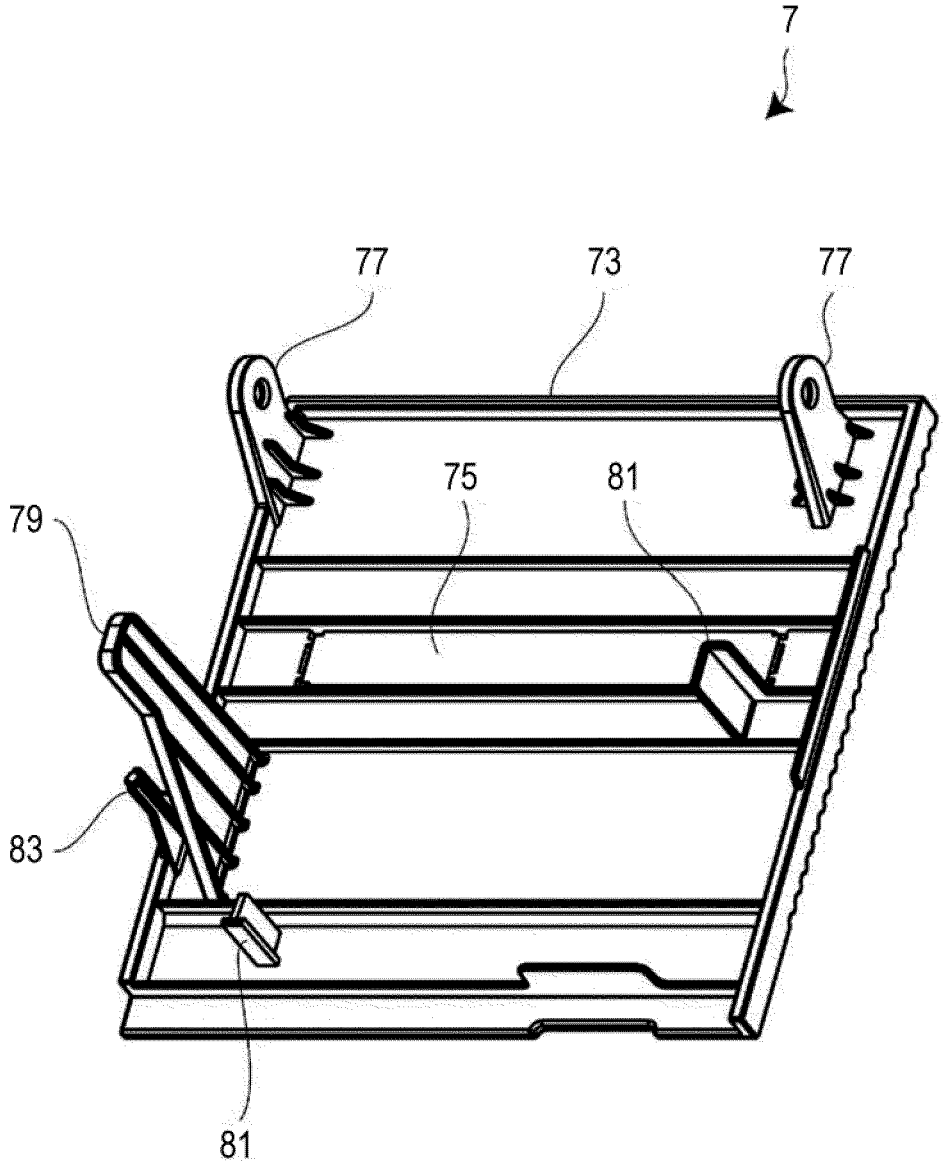
FIG. 8 is a perspective view of an opening and closing lid as viewed from a rear surface side.

As illustrated in FIGS. 1, 5 and 8, the opening and closing lid 7 is rotatably, that is, open-closeably mounted on the device case 3 via a hinge portion 71 provided on a rear side. The opening and closing lid 7 has an opening and closing lid body 73 and a viewing window 75 provided at the center of the opening and closing lid body 73. In addition, the opening and closing lid 7 has a pair of journal pieces 77 that is rotatably journaled on the hinge portion 71 protruding from the rear surface of the opening and closing lid body 73 and an operation lever 79 that protrudes from the rear surface of the opening and closing lid body 73 and rotates the printing head 21. Furthermore, the opening and closing lid 7 has two push protrusions 81 that protrude from the rear surface of the opening and closing lid body 73 and press the tape cartridge 100, and a pressing protrusion 83 that protrudes from the rear surface of the opening and closing lid body 73 and operates (ON) a built-in lid closing detection switch (not illustrated).

The viewing window 75 is formed to be horizontally elongated and is configured of transparent (transparent to visible light) resin as a separate body from the opening and closing lid body 73. The tape cartridge 100 mounted on the cartridge mounting portion 5 is visible (specification of the printing tape 102 and tape remaining amount) over the viewing window 75. In addition, the pair of journal pieces 77, the operation lever 79, the two push protrusions 81, the pressing protrusion 83, and the opening and closing lid body 73 are integrally formed (molded) of resin.

The operation lever 79 largely protrudes from the rear surface of the opening and closing lid body 73 and is inserted into a slit opening 87 provided on the side surface of the cartridge mounting portion 5 in accordance with closing of the opening and closing lid 7. The operation lever 79 inserted into the slit opening 87 operates the head release mechanism and rotates the printing head 21 toward the platen roller 120. Similarly, the pressing protrusion 83 is inserted into a rectangular opening 91 adjacent to the slit opening 87 and turns on the lid closing detection switch in accordance with the closure of the opening and closing lid 7.

One of the push protrusions 81 corresponds to a position in the vicinity of the platen roller 120 of the tape cartridge 100 and the other of the push protrusions 81 corresponds to a position directly above the tape detecting portion 51. If the opening and closing lid 7 is closed, the two push protrusions 81 press the tape cartridge 100 so that the tape cartridge 100 sits on the mounting base 31 of the cartridge mounting portion 5, and prevent floating of the tape cartridge 100.

[Details of Tape Cartridge]

Next, the tape cartridge 100 will be described in detail with reference to FIGS. 2 to 4, and 9. Moreover, in the description of the tape cartridge 100, in the example of FIG. 1, a front surface in the mounting direction, which is an upper front surface of the tape cartridge 100, is referred to as a "front surface", a surface on the rear side in the mounting direction on the opposite side is referred to as a "rear surface", a side surface of the left side is referred to as a "left side surface", a side surface of the right side is referred to as a "right side surface", an arc-shaped side surface on the upper side is referred to as a "leading end surface", and a side surface on the lower side is referred to as a "base end surface".

As described above, the tape cartridge 100 includes the cartridge case 130, the tape roll 106 housed therein, the ribbon roll 114, the winding core 116, and the platen roller 120 (see FIG. 9). In addition, the tape cartridge 100 includes the insertion opening 134 formed in the cartridge case 130, the tape feeding port 138 formed on the left side surface in the vicinity of the platen roller 120, and an identification seal 141 (see FIG. 1) adhered over the front surface, the left side surface, and the right side surface of a portion in which the tape roll 106 is housed. The tape width, the tape color, the material of the housed printing tape 102, or the like (a part of the attribute information) is displayed in two places on the front surface and the left side surface in the identification seal 141.

The cartridge case 130 configures an outer shell of the tape cartridge 100 (shell structure) and has an appearance of an "L" shape in a plan view of which the base end side of the right side surface protrudes somewhat. The cartridge case 130 in a front and rear direction has a lower case 150 that becomes the rear side and an upper case 152 that becomes the front side when being mounted on the cartridge mounting portion 5. The cartridge case 130 of the embodiment is configured such that the upper case 152 is formed of molding of transparent resin and the lower case 150 is formed of molding of opaque resin.

The upper case 152 is formed (molded) integrally with a top wall portion 156 configuring the front surface of the cartridge case 130 and an upper periphery wall portion 158 provided uprightly in a periphery portion of the top wall portion 156. In addition, the lower case 150 is formed (molded) integrally with a bottom wall portion 160 configuring the rear surface of the cartridge case 130, a lower periphery wall 162 provided uprightly in the periphery portion of the bottom wall portion 160, and an opening periphery wall portion 164 provided uprightly in the bottom wall portion 160 in order to define the insertion opening 134.

A plurality of joining pins 170 are provided on the lower end surface of the upper periphery wall portion 158 at appropriate intervals in the upper case 152 and a plurality of joining holes 172, which correspond to the plurality of joining pins 170, are provided in the lower periphery wall 162 of the lower case 150 (see FIG. 9). The tape cartridge 100 is assembled by joining the upper case 152 to the lower case 150 so as to press fit the plurality of joining pins 170 into the plurality of joining holes 172 after setting configuration components such as the tape roll 106 and the ribbon roll 114. Moreover, each joining hole 172 is configured of a through-hole in consideration of ease of molding.

On the other hand, a pair of latch receiving portions 174 that is latched to the pair of latch pieces 57 is provided on the left side surface and the right side surface of the lower case 150 (see FIGS. 2(*e*), 2(*f*), and 3(*b*)). The pair of latch pieces 57 on the cartridge mounting portion 5 side is latched to the pair of latch receiving portions 174 of the mounted tape cartridge 100 and thereby floating of the tape cartridge 100 is prevented. In addition, fitting small holes 176 into which the pair of small protrusions 55 are fitted with clearance somewhat are provided on the rear surface of the lower case 150 (see FIG. 3(*b*)). The pair of small protrusions 55 on the cartridge mounting portion 5 side is fitted into a pair of fitting small holes 176 of the mounted tape cartridge 100 and thereby simple positioning of the tape cartridge 100 is performed on the mounting base 31.

Figure 3:
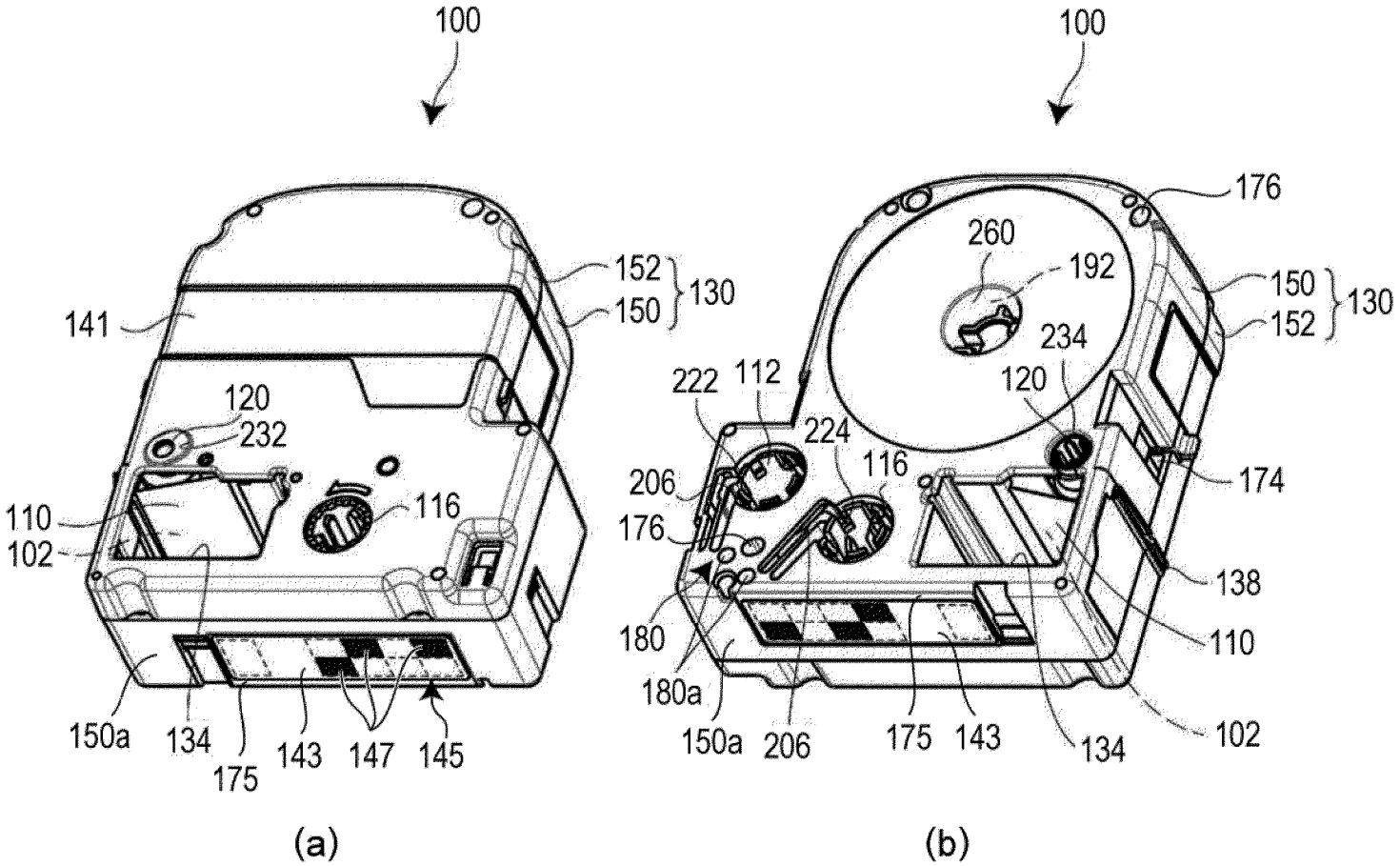
FIG. 3(*a*) is a perspective view when viewed in plan view and 3(*b*) is a perspective view when viewed in rear view of the tape cartridge according to the embodiment.

In addition, a tape detected portion 180, which is positioned in a left corner portion (right corner portion viewed on the front surface side) on the base end surface side and corresponds to the tape detecting portion 51, is provided on the rear surface of the lower case 150 (see FIG. 3(*b*)). The tape detected portion 180 is configured in a portion corresponding to the plurality of micro switches 51*a* of the tape detecting portion 51 and obtains a plurality of bit patterns by the presence or absence of receiving holes 180*a* provided in the portion. That is, the bit pattern corresponds to the above-described specification of the printing tape 102.

Furthermore, the tape cartridge 100 includes a specification display seal 141 (see FIG. 1) adhered over the front surface, the left side surface, and the right side surface of a portion in which the tape roll 106 is housed, and the specification reading seal 143 (see FIGS. 2(*c*) and 3) as the detected portion adhered to a base end surface 150*a* of the lower case 150 of the cartridge case 130.

The specification information (tape width, the tape color, the material of the housed printing tape 102, or the like) of the tape cartridge 100 is displayed on the specification display seal 141.

Figure 16:
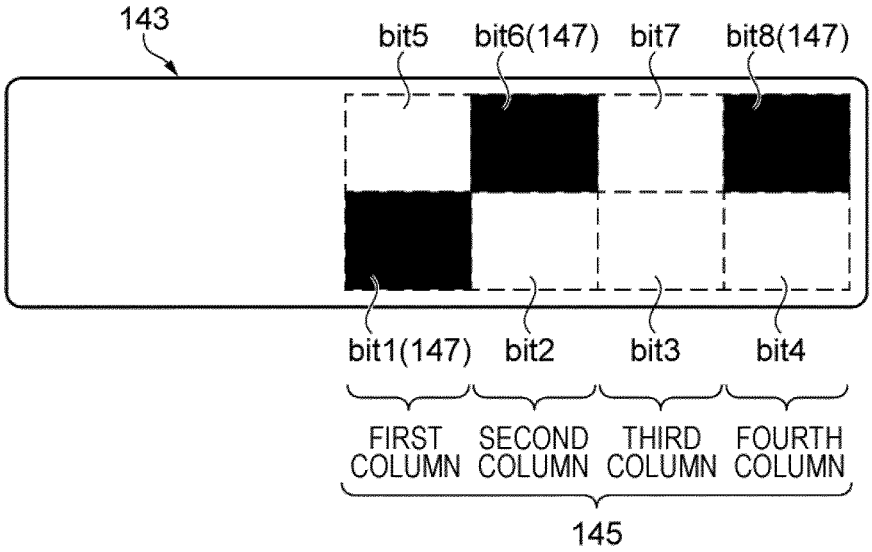
FIG. 16 is a plan view of a configuration of a detected portion in the tape cartridge.
Figure 17:
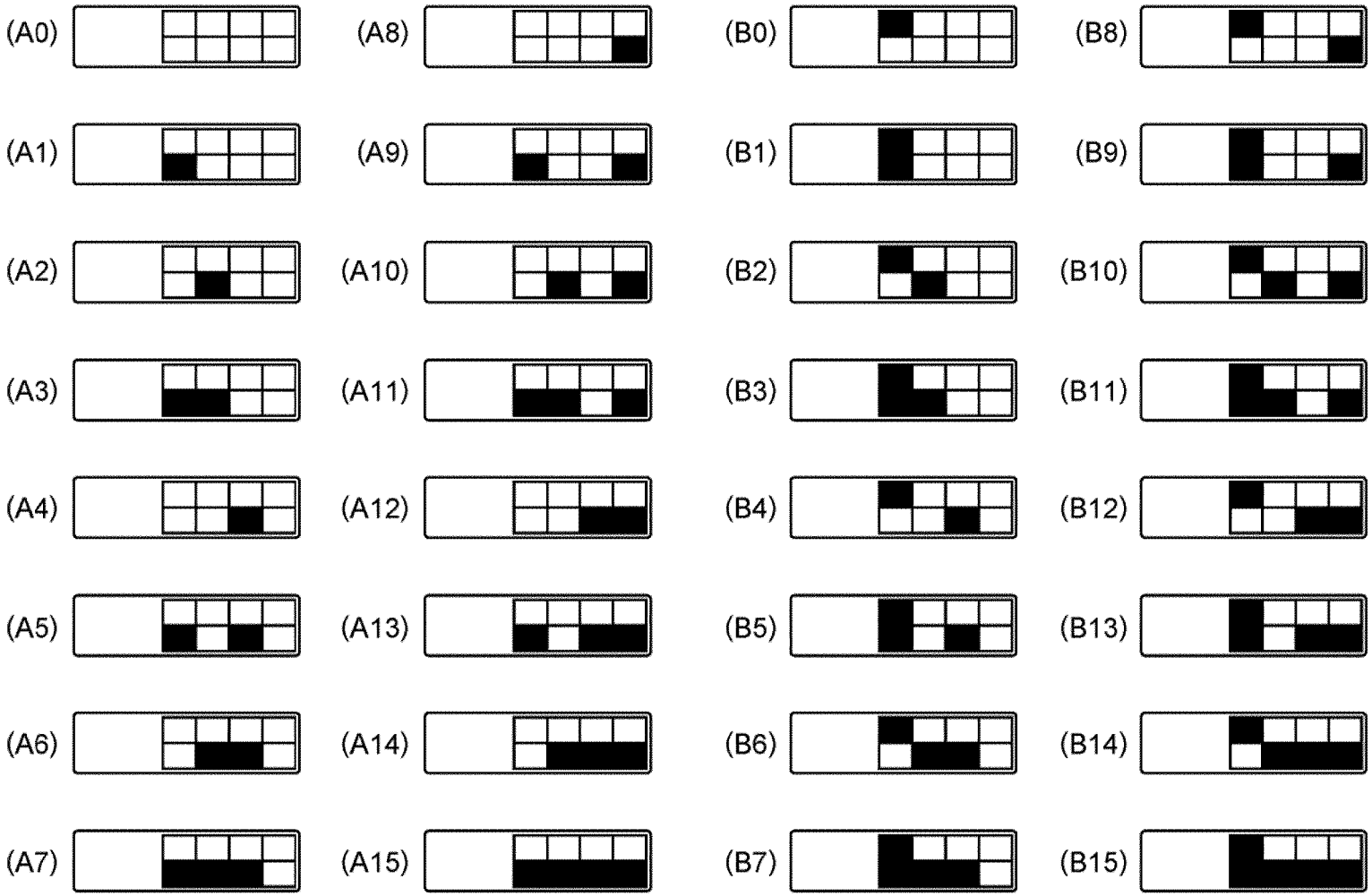
FIG. 17 is a plan view illustrating an example of a combination of identification portions in the detected portion.
Figure 18:
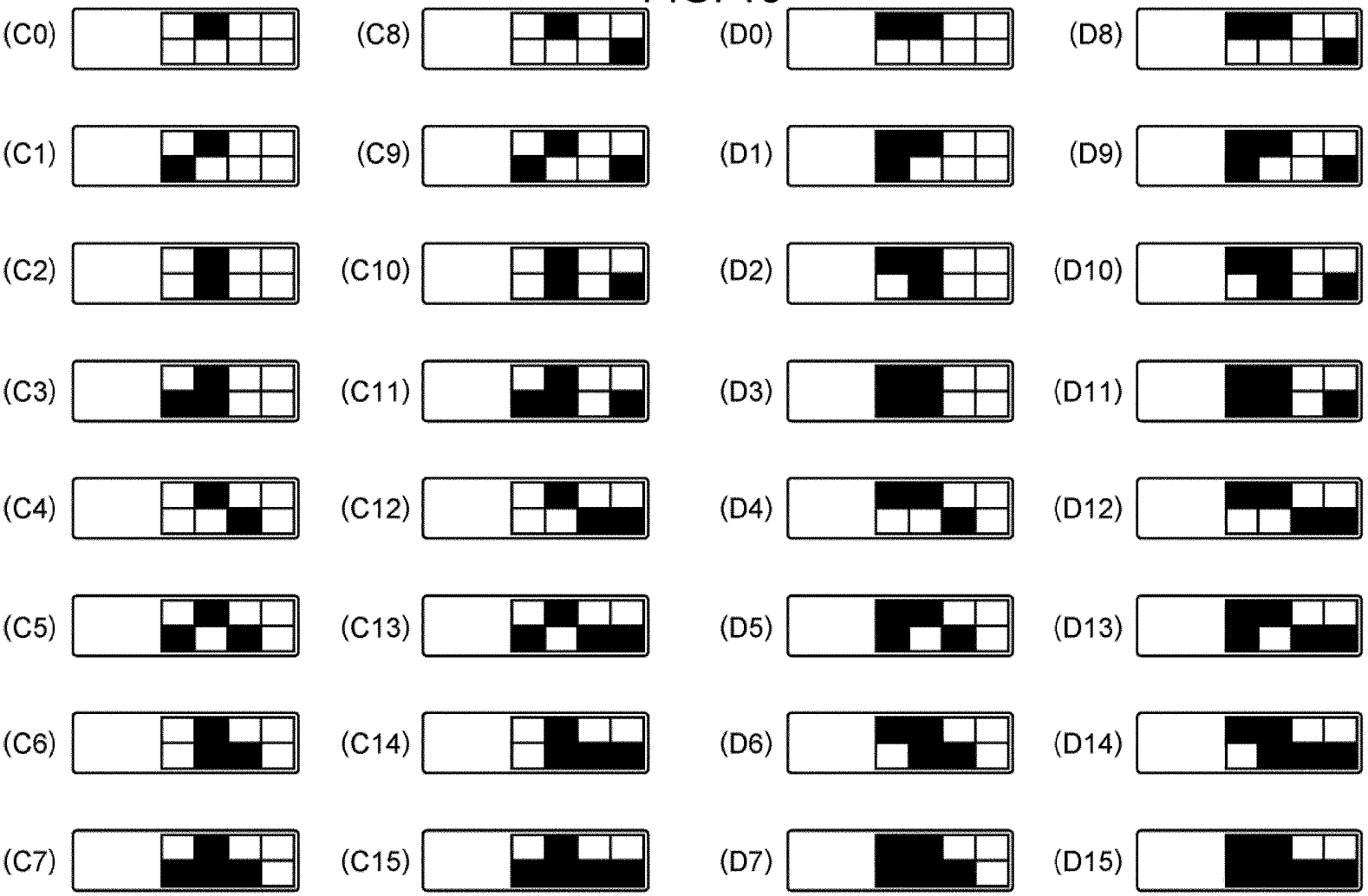
FIG. 18 is a plan view illustrating an example of a combination of identification portions in the detected portion.
Figure 19:
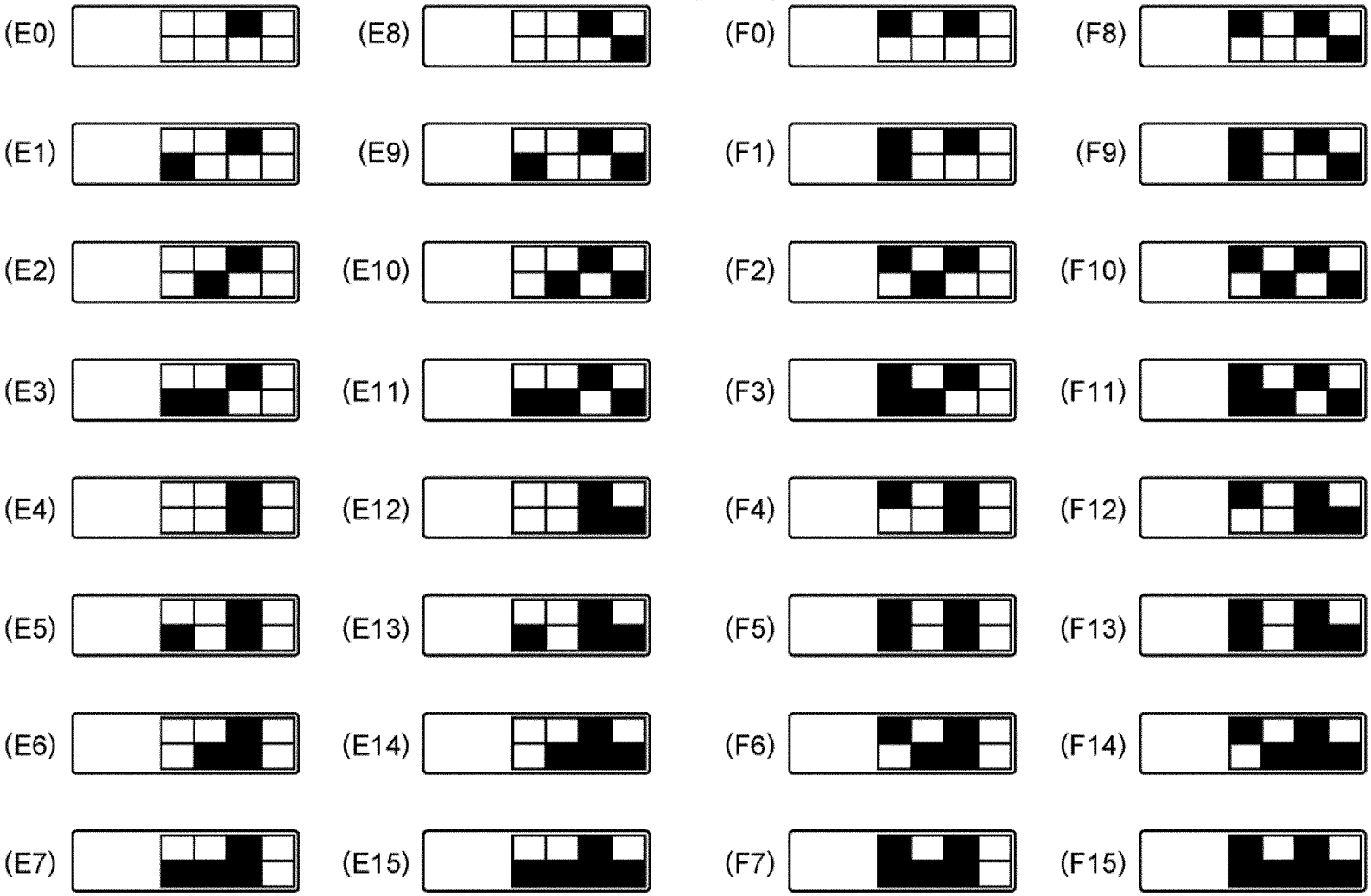
FIG. 19 is a plan view illustrating an example of a combination of identification portions in the detected portion.
Figure 20:
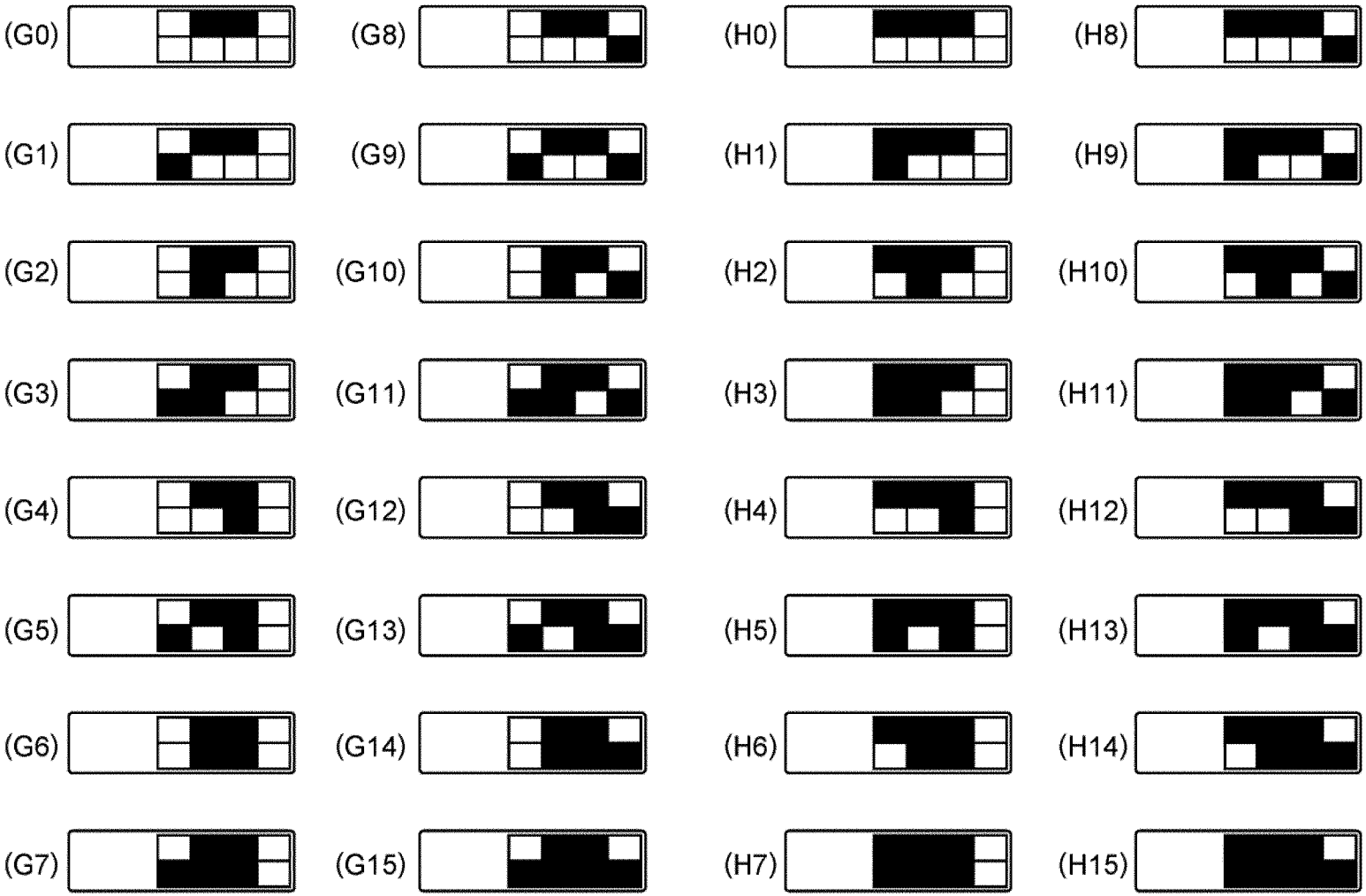
FIG. 20 is a plan view illustrating an example of a combination of identification portions in the detected portion.
Figure 21:
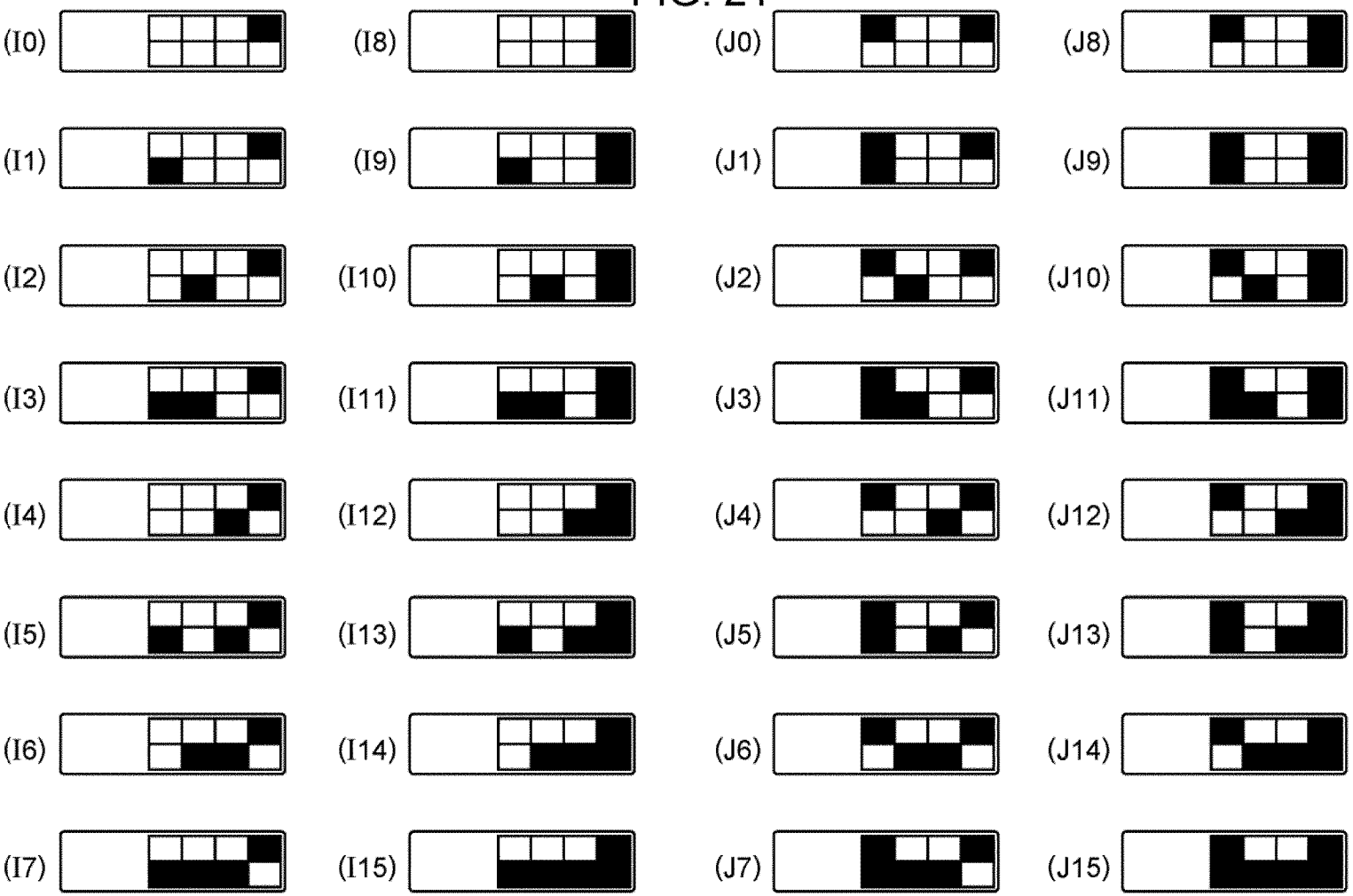
FIG. 21 is a plan view illustrating an example of a combination of identification portions in the detected portion.
Figure 22:
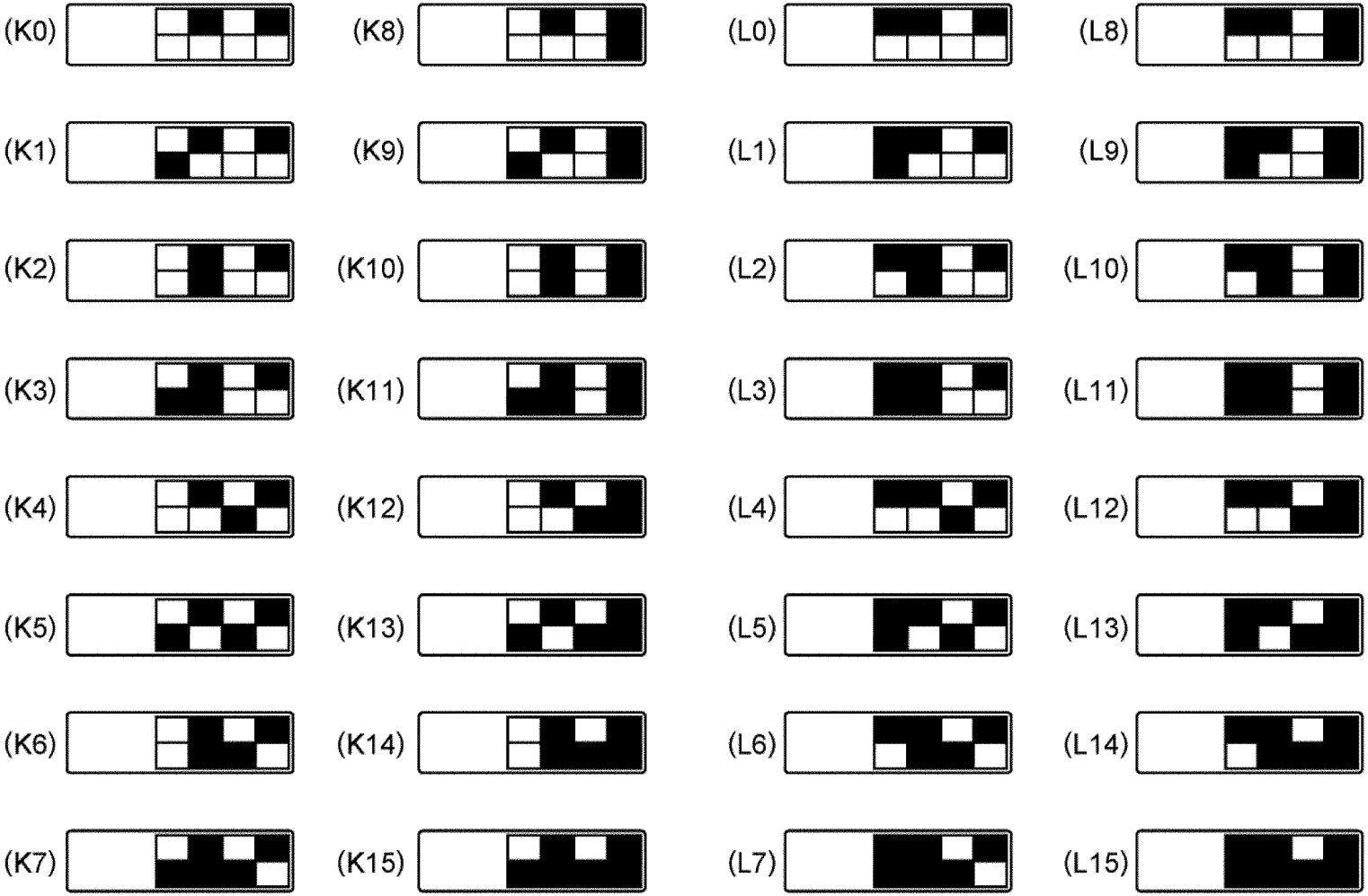
FIG. 22 is a plan view illustrating an example of a combination of identification portions in the detected portion.
Figure 23:
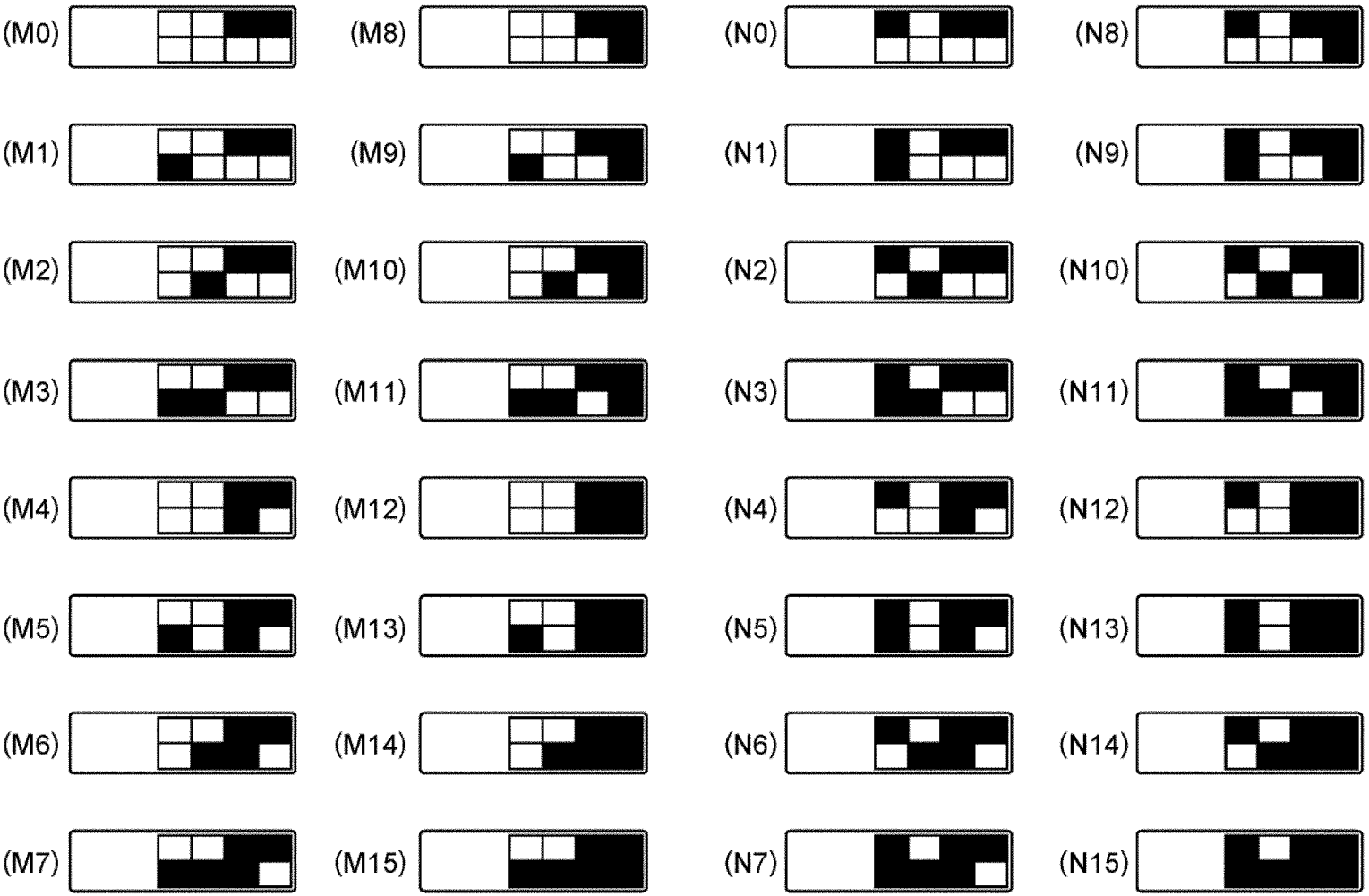
FIG. 23 is a plan view illustrating an example of a combination of identification portions in the detected portion.
Figure 24:
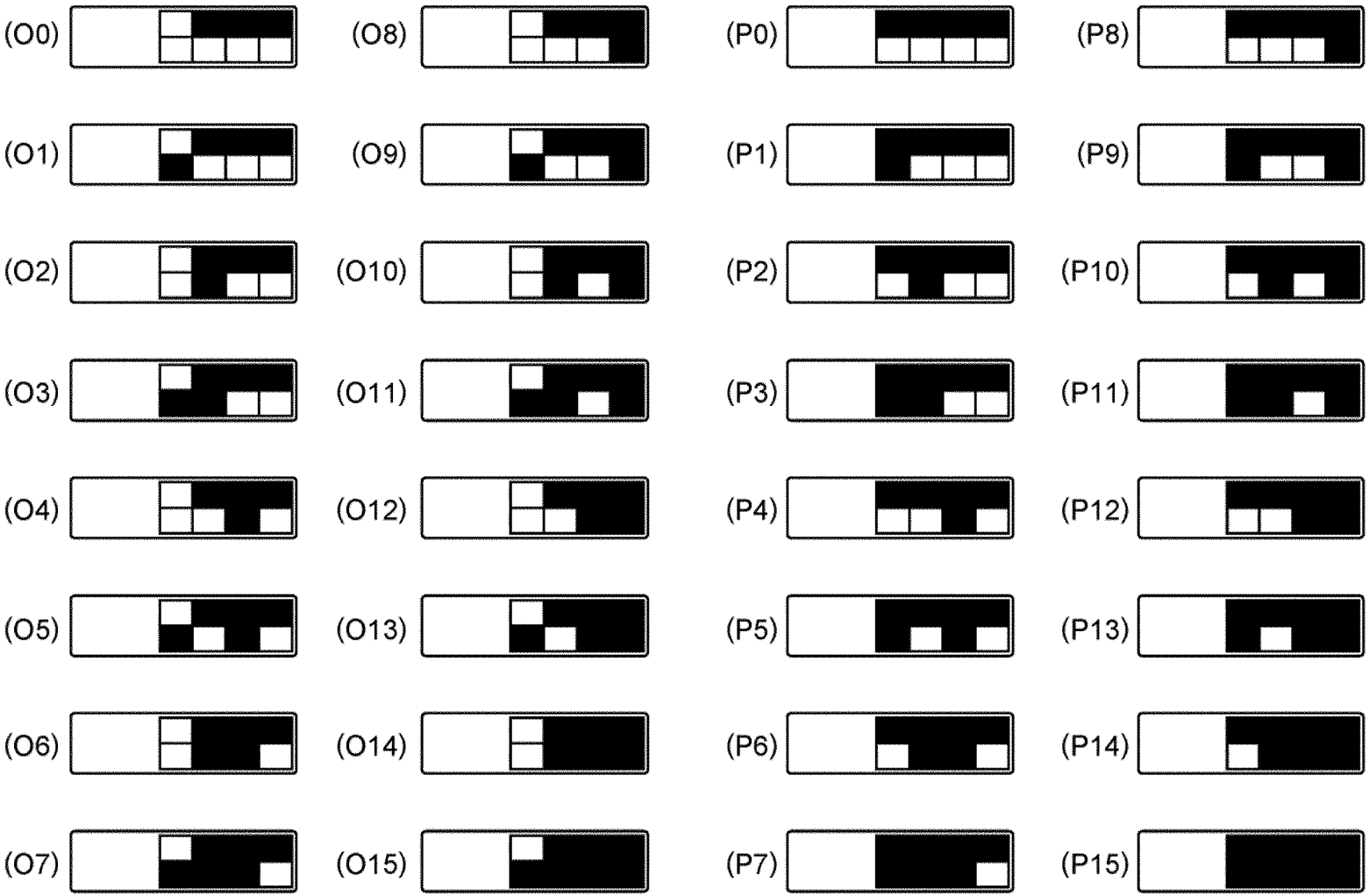
FIG. 24 is a plan view illustrating an example of a combination of identification portions in the detected portion.

On the other hand, a bit configuration portion 145 is provided in the specification reading seal 143 as the detected portion, and an identification portion 147, which configures the bit pattern (specification reading pattern) indicating the specification information (tape color, the material of the housed printing tape 102, a ribbon color of the housed ink ribbon 110, or the like) of the tape cartridge 100, is disposed in the bit configuration portion 145 (see FIG. 16). Moreover, details of the bit configuration portion 145 and the identification portion 147 configuring the bit pattern (specification reading pattern) will be described later.

Moreover, as illustrated in FIGS. 2(*c*) and 3, a reading seal adhering portion 175 for adhering to the specification reading seal 143 may be formed in the base end surface 150*a* of the lower case 150. The reading seal adhering portion 175 is concavely provided with respect to the base end surface 150*a* so that a rectangular concave portion has a depth corresponding to a thickness (or more than the thickness) of the specification reading seal 143. The reading seal adhering portion 175 prevents the specification reading seal 143 from protruding from the base end surface 150*a*.

As illustrated in FIG. 9, a tape housing area 190, in which the wide tape roll 106 is housed, is configured in an upper space (leading end surface side) within the cartridge case 130. The core shaft 192 formed (molded) integrally with the lower case 150 is provided uprightly at the center of the tape housing area 190. The core shaft 192 is formed in a stepped cylindrical shape and the tape roll 106 (tape core 104) is rotatably journaled on an outer peripheral surface 192*b* thereof (see FIG. 4).

Although details will be described later, the core concave portion 260, which is formed in a stepped cylindrical shape and where the base convex portion 40 is fitted into an inner periphery side thereof, is formed in the core shaft 192. The core concave portion 260 has a depressed portion 262 into which the pedestal portion 41 of the base convex portion 40 is fitted and an identification concave portion 264 as a fitting unit into which the identification convex portion 42 is fitted. In addition, a reverse rotation stop spring 193 of the tape roll 106 configured by a coil spring is incorporated in an upper portion of the core concave portion 260.

In addition, as illustrated in FIG. 9, a tape guide 194, which is positioned in the vicinity of the platen roller 120 and guides the fed printing tape 102 to the platen roller 120, is provided uprightly and integrally with the lower case 150 in the tape housing area 190. That is, a tape delivery path 196 from the tape roll 106 as a starting point to the tape feeding port 138 through the tape guide 194 and the platen roller 120 is configured within the cartridge case 130. The printing tape 102 fed from the tape roll 106 is guided to the platen roller 120 via the tape guide 194, is subjected to printing in the platen roller 120, and is further guided from the platen roller 120 to the tape feeding port 138.

The tape roll 106 has the printing tape 102 and the tape core 104, and also has two circular films 198 adhered on both end surfaces of the printing tape 102 of a roll shape. The two circular films 198 prevent loosening of the printing tape 102 wound around the tape core 104.

Figure 4:
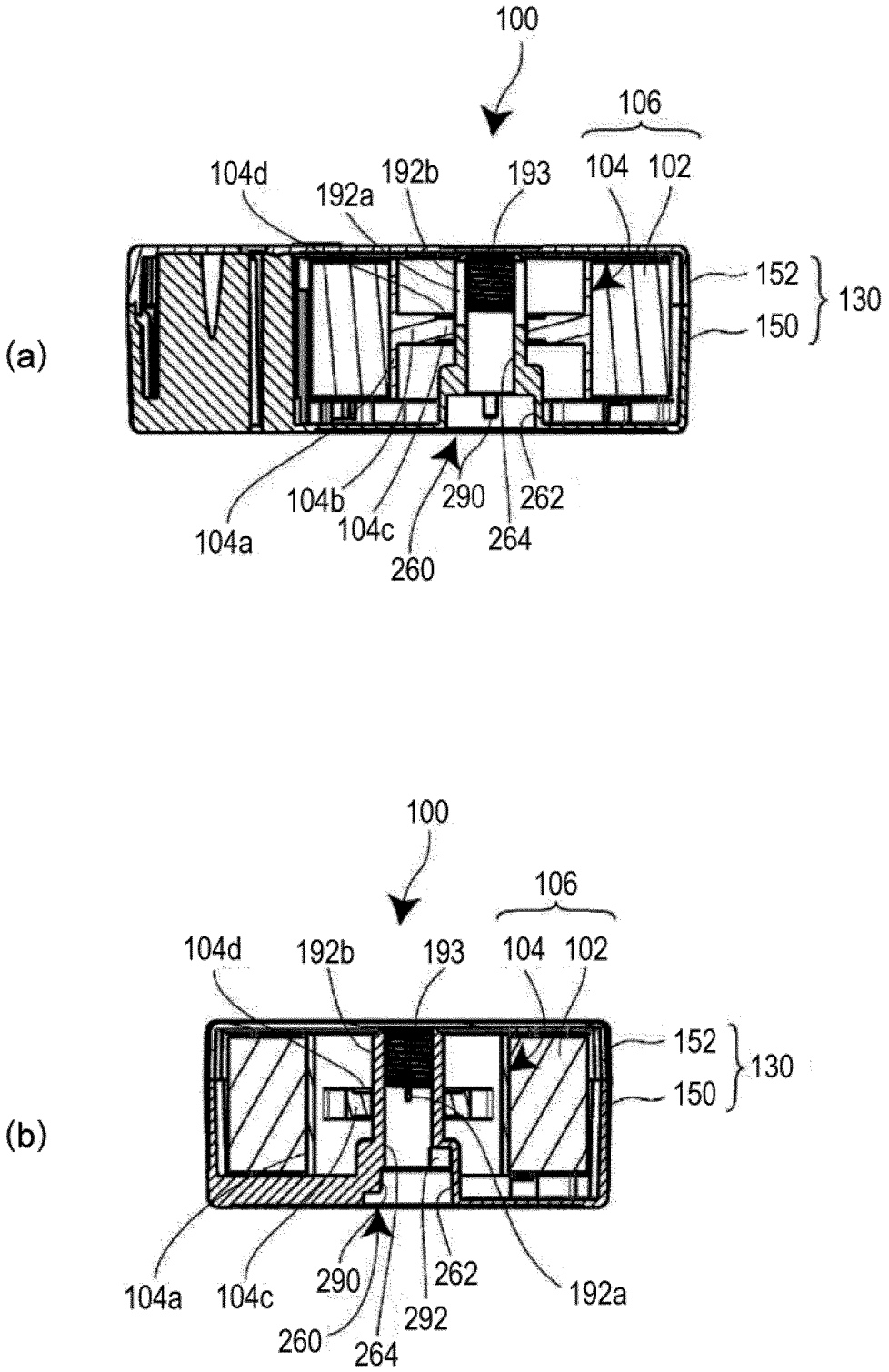
FIG. 4(*a*) is a sectional view that is taken along line A-A and 4(*b*) is a sectional view that is taken along line B-B in FIG. 2(*a*).

As illustrated in FIGS. 4 and 9, the tape core 104 has a reel portion 104*a* around which the printing tape 102 is wound, and a rolling contact portion 104*c* which is provided on an inside of the reel portion 104*a* via a plurality of inwardly directed ribs 104*b*, and is rotatably journaled on the above-described core shaft 192 by the rolling contact portion 104*c*. In addition, a plurality of radial end surface grooves 104*d* are formed on an end surface of the rolling contact portion 104*c* and the reverse rotation stop spring 193 is engaged with and disengaged with the end surface groove 104*d*. That is, a longitudinal slit 192*a* extending in the axial direction is formed at an upper portion of the core shaft 192, an end portion of a wire material of the reverse rotation stop spring 193 protrudes from the longitudinal slit 192*a*, and is engaged with the end surface groove 104*d* of the rolling contact portion 104*c*.

When carrying the tape cartridge 100, the reverse rotation of the tape roll 106 (printing tape 102) is prevented by the reverse rotation stop spring 193. On the other hand, if the tape cartridge 100 is mounted on the cartridge mounting portion 5, the reverse rotation stop spring 193 is compressed by the base convex portion 40, the end portion of the wire material is released from the end surface groove 104*d* of the rolling contact portion 104*c*, and reverse rotation stop is released (both, see FIG. 13). Therefore, delivery of the printing tape 102 may be performed.

As illustrated in FIG. 9, a ribbon housing area 200 is configured adjacent to the insertion opening 134 on the right side of the base portion on the inside of the cartridge case 130. A feeding-side bearing portion 202 rotatably supporting the ribbon roll 114 (feeding core 112) is formed integrally with the cartridge case 130 on the right side of the ribbon housing area 200 and a winding-side bearing portion 204 rotatably supporting the winding core 116 is formed integrally with the cartridge case 130 on the left side thereof. That is, the feeding-side bearing portion 202 and the winding-side bearing portion 204 are respectively formed in the upper case 152 and the lower case 150.

The rotation stopper hooks 206 of which leading end portions face the feeding-side bearing portion 202 and the winding-side bearing portion 204 are respectively and integrally formed in cutout portions of the feeding-side bearing portion 202 and the winding-side bearing portion 204 formed in the lower case 150. Then, one rotation stopper hook 206 is engaged with the feeding core 112 and the other rotation stopper hook 206 is engaged with the winding core 116 respectively in a rotation stop state.

A first ribbon guide 210, which is positioned in the vicinity of the feeding-side bearing portion 202 and guides the fed ink ribbon 110 to the platen roller 120, is provided uprightly and integrally with the lower case 150 in the ribbon housing area 200. In addition, a plurality of second ribbon guides 212, which guide rotation of the ink ribbon 110, are integrally formed on an outer periphery side of the opening periphery wall portion 164.

That is, a ribbon delivery path 214 from the ribbon roll 114 as a starting point to the winding core 116 through the first ribbon guide 210, the platen roller 120, and the plurality of second ribbon guides 212 is configured on the inside of the cartridge case 130. The ink ribbon 110 fed from the ribbon roll 114 is guided to the platen roller 120 via the first ribbon guide 210, where it is subjected to printing, and is wound around the winding core 116 by the rotation of the opening periphery wall portion 164 (plurality of second ribbon guides 212) from the platen roller 120.

The ribbon roll 114 has the ink ribbon 110 and the feeding core 112, and also has an annular leaf spring 220 applying a braking load to the feeding core 112 (see FIG. 9(*b*)). The leaf spring 220 is formed in a wave shape in a circumferential direction and is interposed between the top wall portion 156 of the upper case 152 and the feeding core 112 in the axial direction. That is, a rotational braking load is applied to the feeding core 112 by an elastic force of the leaf spring 220. Therefore, back tension is applied to the ink ribbon 110 that is fed by the winding core 116 and slack thereof is prevented.

The feeding core 112 is formed in a cylindrical shape and a plurality of cutouts 222 are formed in an end portion on the lower case 150 side in the circumferential direction (see FIG. 3(*b*)). Then, the rotation stopper hooks 206 are engaged and disengaged with the plurality of cutouts 222. Moreover, the feeding-side bearing portion 202 on the lower case 150 side supporting the feeding core 112 is configured of a circular opening and the feeding-side bearing portion 202 on the upper case 152 side is configured of a cylindrical protrusion portion. Then, the leaf spring 220 is mounted on the protrusion portion (both, see FIG. 9(*b*)).

Similarly, the winding core 116 is formed in a cylindrical shape and a plurality of cutouts 224 are formed in an end portion on the lower case 150 side in the circumferential direction (see FIG. 3(*b*)). Then, the rotation stopper hooks 206 are engaged and disengaged with the plurality of cutouts 224. In addition, spline-like slit grooves 226 are formed on an inner peripheral surface of the winding core 116 and are spline-engaged with the winding driving shaft 47. Therefore, the rotational force of the winding driving shaft 47 is transmitted to the winding core 116 and the ink ribbon 110 is wound.

A platen housing area 230 is configured adjacent to the insertion opening 134 on the left side of the base portion within the cartridge case 130. A lower bearing portion 234 (see FIG. 3(*b*)) of an elliptical opening formed in the lower case 150 and an upper bearing portion 232 (see FIG. 9(*b*)) of an elliptical opening formed in the upper case 152 are provided at the center of the platen housing area 230. Then, the platen roller 120 is supported on the upper bearing portion 232 and the lower bearing portion 234 rotatably and slightly movably in lateral direction. That is, the platen roller 120 supported on the upper bearing portion 232 and the lower bearing portion 234 having the elliptical shape is configured to be movable in the lateral direction (fine movement) between a home position to be engaged with the platen driving shaft 45 and a clamped position to come into contact with the tape guide 194 by sandwiching the printing tape 102.

Meanwhile, the tape cartridge 100 carries the feeding end portion of the printing tape 102 in a state of slightly protruding from the tape feeding port 138 to the outside (see FIG. 1). In this case, if a pushing force or a pulling force accidentally acts on the feeding end portion of the printing tape 102, the platen roller 120 dragged thereto is moved to the clamped position. Therefore, the feeding end portion of the printing tape 102 is prevented from being drawn from the tape feeding port 138 into the cartridge case 130.

The platen roller 120 has a cylindrical roller base body 240 and a rubber roller 242 mounted on an outer peripheral surface of the roller base body 240 (see FIG. 10). The rubber roller 242 has a length corresponding to the printing head 21 in the axial direction and the printing head 21 moved to the printing position comes into contact with the rubber roller 242 by sandwiching the printing tape 102 and the ink ribbon 110.

In addition, a spline boss portion 244 is formed as a fitting portion on a base portion of the roller base body 240 and the spline driving shaft 49 (driving shaft) of the platen driving shaft 45 is spline-engaged with the spline boss portion 244 (see FIG. 10). Therefore, the rotational force of the platen driving shaft 45 is transmitted to the platen roller 120 and print feeding of the printing tape 102 (and the ink ribbon 110) is performed.

[Structures of Core Concave Portion and Platen Roller]

Next, structures of the core concave portion 260 and the platen roller 120 of the tape cartridge 100 will be described in detail together with the base convex portion 40 and the platen driving shaft 45 of the cartridge mounting portion 5 with reference to FIGS. 10 to 13. As described above, the platen driving shaft 45 and the base convex portion 40 are provided in the cartridge mounting portion 5 so as to be separated from each other, and the platen roller 120 and the core concave portion 260 are provided in the tape cartridge 100.

As illustrated in FIG. 10(*a*), the platen driving shaft 45 has the fixed support shaft 48 which is provided uprightly in a device frame 270 positioned below the mounting base 31 and the spline driving shaft 49 rotatably supported on a lower portion of the fixed support shaft 48. The fixed support shaft 48 is fixed to the device frame 270 in a cantilever manner, penetrates the mounting base 31, and extends in the attaching and detaching direction of the tape cartridge 100. The spline driving shaft 49 has a gear portion 272 of the base portion and a spline shaft portion 274 extending from the gear portion 272, and a gear train of the tape feeding mechanism portion 25 is connected to the gear portion 272.

On the other hand, as described above, the platen roller 120 has the roller base body 240 and the rubber roller 242, and the spline boss portion 244 is formed in the base portion of the roller base body 240. That is, the spline boss portion 244 spline-engaged with the spline shaft portion 274 is formed in the roller base body 240.

If the tape cartridge 100 is mounted on the cartridge mounting portion 5, the fixed support shaft 48 of the platen driving shaft 45 passes through the roller base body 240 of the platen roller 120. In addition, the spline shaft portion 274 of the platen driving shaft 45 is engaged with the spline boss portion 244 of the platen roller 120.

As illustrated in FIG. 10(*b*), a plurality of spline teeth 274*a* are formed in the spline shaft portion 274 in the circumferential direction and a plurality of spline grooves 244*a* corresponding to the plurality of spline teeth 274*a* are formed in the spline boss portion 244. In this case, unlike a general spline structure, the number of the spline grooves 244*a* is greater than the number of teeth of the spline teeth 274*a*. In addition, intervals of the plurality of spline grooves 244*a* in the circumferential direction are formed greater than intervals of the plurality of spline teeth 274*a* in the circumferential direction. Specifically, the number of grooves of the spline grooves 244*a* is six and the number of teeth of the spline teeth 274*a* is three, and the spline teeth 274*a* mesh with every other spline grooves 244*a*. In addition, a base portion of an inner peripheral surface of the spline boss portion 244 is chamfered and has a so-called guiding shape (see FIG. 10(*a*)).

As described above, fitting (engagement) of the spline shaft portion 274 to the spline boss portion 244 is smoothly performed by the difference in the number of grooves and the number of teeth in the spline engagement, and the guiding shape of the spline boss portion 244. That is, the tape cartridge 100 can be smoothly mounted on the cartridge mounting portion 5.

Figure 11:
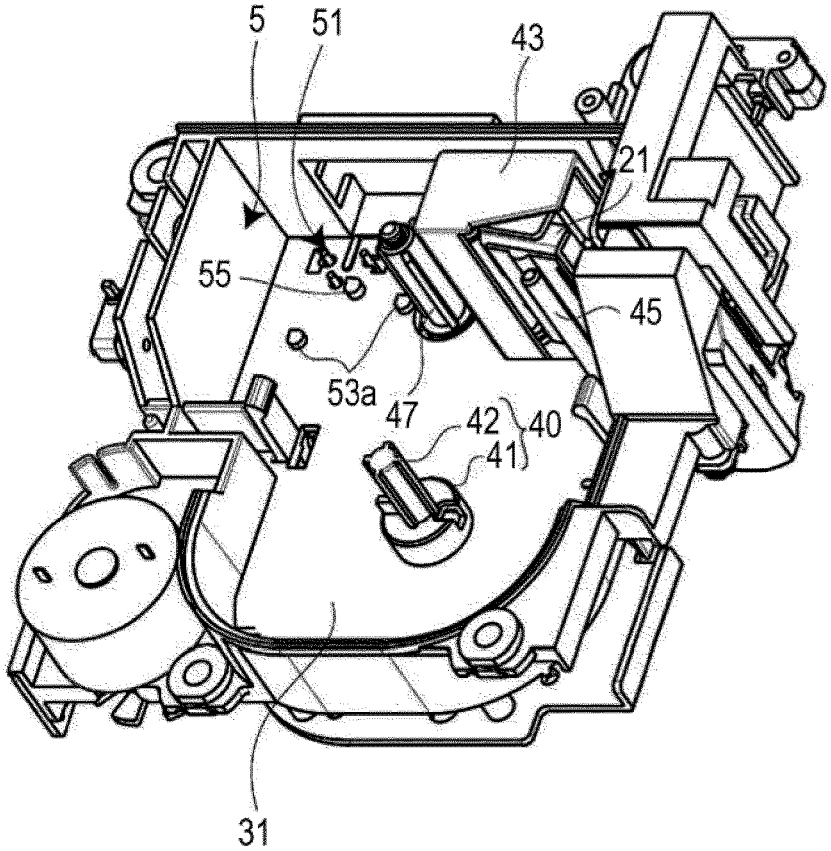
FIG. 11(*a*) is a perspective view of the cartridge mounting portion and 11(*b*) is an enlarged perspective view around a base convex portion.
Figure 11:
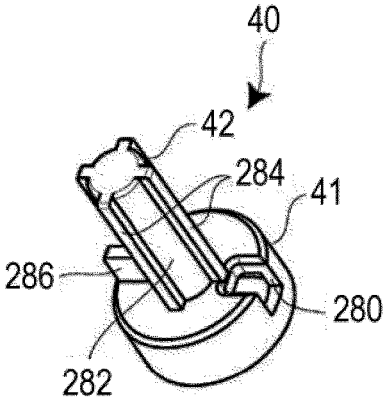
Figure 13:
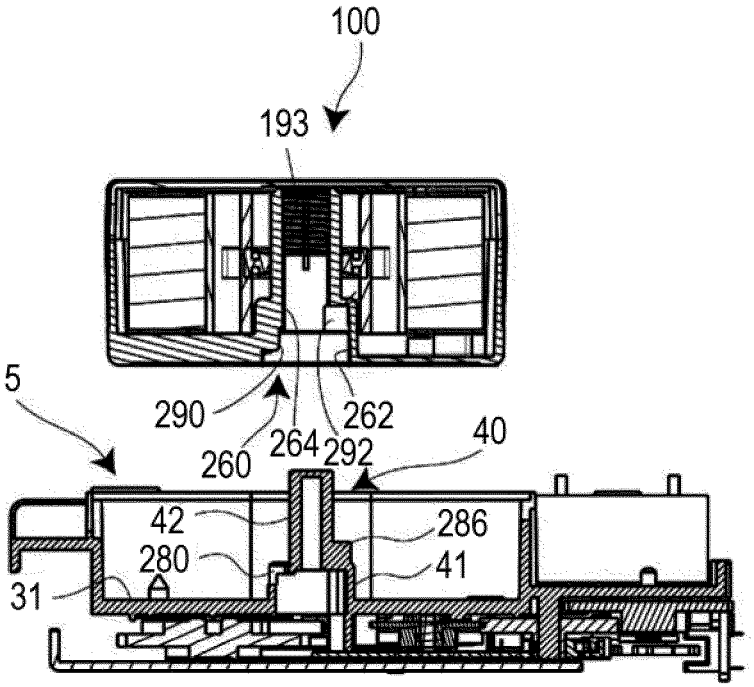
FIG. 13(*a*) is a sectional view of the tape cartridge in a non-mounted state with respect to a cartridge mounting portion and 13(*b*) is a sectional view of the tape cartridge in a mounted state.
Figure 13:
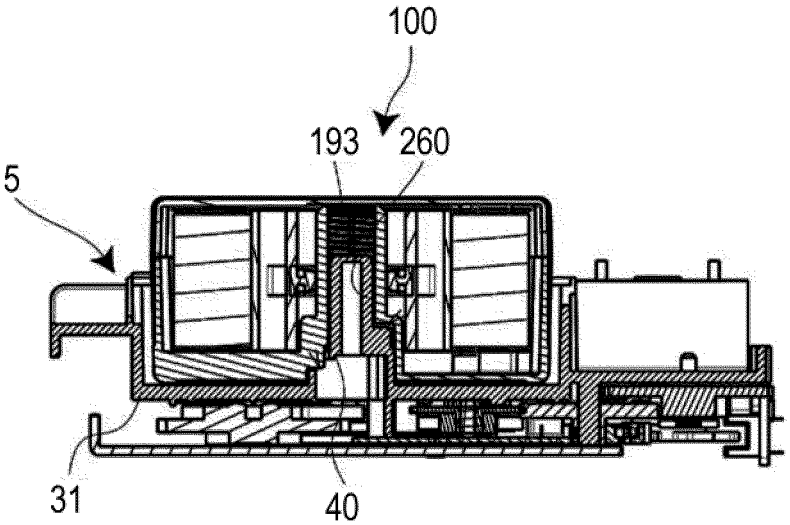

As illustrated in FIGS. 11 and 13, the base convex portion 40 is formed integrally with the pedestal portion 41 provided uprightly on the mounting base 31 and the identification convex portion 42 provided uprightly on the pedestal portion 41. The pedestal portion 41 is circularly formed and has a cutout opening portion 280 at a part thereof in the circumferential direction. In addition, the identification convex portion 42 has a columnar (hollow) convex portion body 282, four projected streak portions 284 provided so as to form a cross shape on an outer peripheral surface of the convex portion body 282, and a tongue piece 286 protruding in a radial direction so as to follow the upper surface of the pedestal portion 41 from the convex portion body 282.

Figure 12:
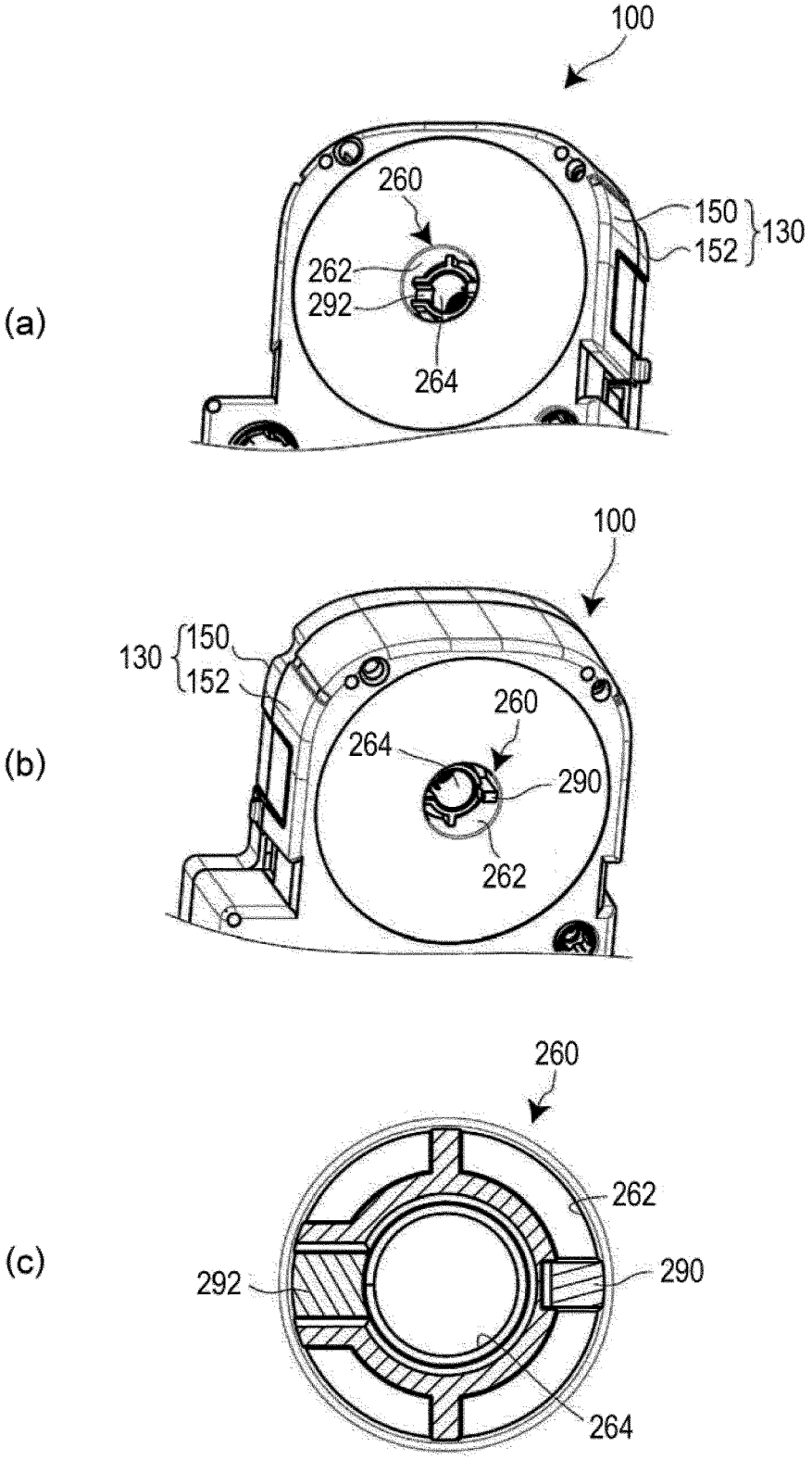
FIG. 12(*a*) is an enlarged perspective view of the tape cartridge as viewed from a right side of a rear surface, 12(*b*) is an enlarged perspective view thereof as viewed from a left side of the rear surface, and 12(*c*) is an enlarged plan view around a core concave portion.

On the other hand, as illustrated in FIGS. 12 and 13, the core concave portion 260 has a depressed portion 262 to which the pedestal portion 41 of the base convex portion 40 is fitted and the identification concave portion 264 to which the identification convex portion 42 is fitted. The depressed portion 262 and the identification concave portion 264 constitute an integral space. Therefore, the identification concave portion 264 is provided with a fitting convex portion 290 (protrusion portion) corresponding to the cutout opening portion 280 so as to protrude toward the space in the axial direction. In addition, the identification concave portion 264 is provided with a fitting concave portion 292 corresponding to the tongue piece 286 of the identification convex portion 42 so as to be retracted from the space.

If the tape cartridge 100 is mounted on the cartridge mounting portion 5, the pedestal portion 41 of the base convex portion 40 is fitted to the depressed portion 262 of the core concave portion 260 and the identification convex portion 42 of the base convex portion 40 is fitted to the identification concave portion 264 of the core concave portion 260 (see FIG. 13). In addition, in accordance with the fitting, the fitting convex portion 290 is fitted to the cutout opening portion 280 and the tongue piece 286 is fitted to the fitting concave portion 292.

Meanwhile, in the tape cartridge 100 of the embodiment, the tape roll 106 is extremely heavy among the configuration components and the center of gravity exists in the vicinity of the tape core 104 in a plan view. Therefore, when gripping the tape cartridge 100 at the time of mounting, the tape cartridge 100 has a strong tendency to tilt obliquely downward unless otherwise noticed. In this case, before the identification convex portion 42 is fitted to the identification concave portion 264, the identification convex portion 42 easily abuts against the depressed portion 262 and thereby a posture of the inclined tape cartridge 100 is corrected. That is, since the tape cartridge 100 is corrected to a horizontal posture upon mounting, it is possible to smoothly perform the mounting (details will be described later).

In addition, in the embodiment, the identification of the cartridge specification is performed by cooperation of the core concave portion 260 and the base convex portion 40. In this case, the cartridge specification is not the specification of the printing tape 102 (tape specification is detected by the tape detecting portion 51) and, for example, identification of the application (for industrial or home), a destination region (to U.S.A. or Europe).

Therefore, although not illustrated in particularly, a plurality of specifications of tape cartridges 100 by a destination region (usage) shifted (phase is shifted) in which the position of the fitting concave portion 292 in the core concave portion 260 is shifted (phase is shifted) by, for example, 90° pitch in the circumferential direction is prepared. In addition, a plurality of specifications of the tape printing devices 1 by the destination region (usage) in which a phase of the tongue piece 286 in the base convex portion 40 is shifted is prepared (first identification pattern).

In addition, in order to increase the number of the cartridge specifications, a pattern (pattern in which the phase of the cutout opening portion 280 in the base convex portion 40 is shifted) in which the phase of the fitting convex portion 290 in the core concave portion 260 is shifted is also added (second identification pattern). Moreover, instead of shifting the phase (first identification pattern and/or second identification pattern), or in addition to shifting the phase, a shape of the fitting concave portion 292 (tongue piece 286) or the fitting convex portion 290 (cutout opening portion 280) may be changed.

As described above, according to the tape cartridge 100 of the embodiment, since the identification concave portion 264 is disposed in the depressed portion 262, when mounting is performed, before fitting of the identification concave portion 264 is started with respect to the identification convex portion 42 of the base convex portion 40, the identification convex portion 42 once abuts against the depressed portion 262 and the posture of the tape cartridge 100 is corrected. Therefore, before fitting of the identification concave portion 264 is started to the identification convex portion 42, it is possible to increase the possibility that fitting of the spline boss portion 244 is started to the spline driving shaft 49 (spline shaft portion 274). That is, when the tape cartridge 100, is mounted even if mounting is started in an inclined posture, fitting can be started from the spline boss portion 244.

Thus, it is possible to suppress a trouble that the spline boss portion 244 is held on the spline driving shaft 49 or the like. In addition, since fitting of the spline boss portion 244 with respect to the identification concave portion 264 precedes, it is possible to correct the inclination and position of the tape cartridge 100 when mounting is started. Furthermore, a timing difference is provided between the start of fitting of the spline boss portion 244 and the start of fitting of the identification concave portion 264, and thereby it is possible to disperse an impact force at the time of mounting. Therefore, it is possible to smoothly mount the tape cartridge 100 on the mounting portion of the tape printing device 1.

In addition, since the identification concave portion 264 is provided in the depressed portion 262, it is possible to substantially shorten the identification concave portion 264 (the core shaft 192) in length and it is possible to maintain appropriate strength. Furthermore, the identification concave portion 264 is unlikely to receive a direct impact force against a drop impact or the like. Therefore, it is possible to make the identification concave portion 264 be a structure which is hard to break. Furthermore, even if there is a protrusion such as the fitting convex portion 290 in the identification concave portion 264, the protrusion does not protrude from an outer surface of the tape cartridge 100 by the depressed portion 262 and in a case where the tape cartridges 100 are stacked and stored, the fitting convex portion 290 or the like does not become an obstacle.

First Modification Example

Figure 14:
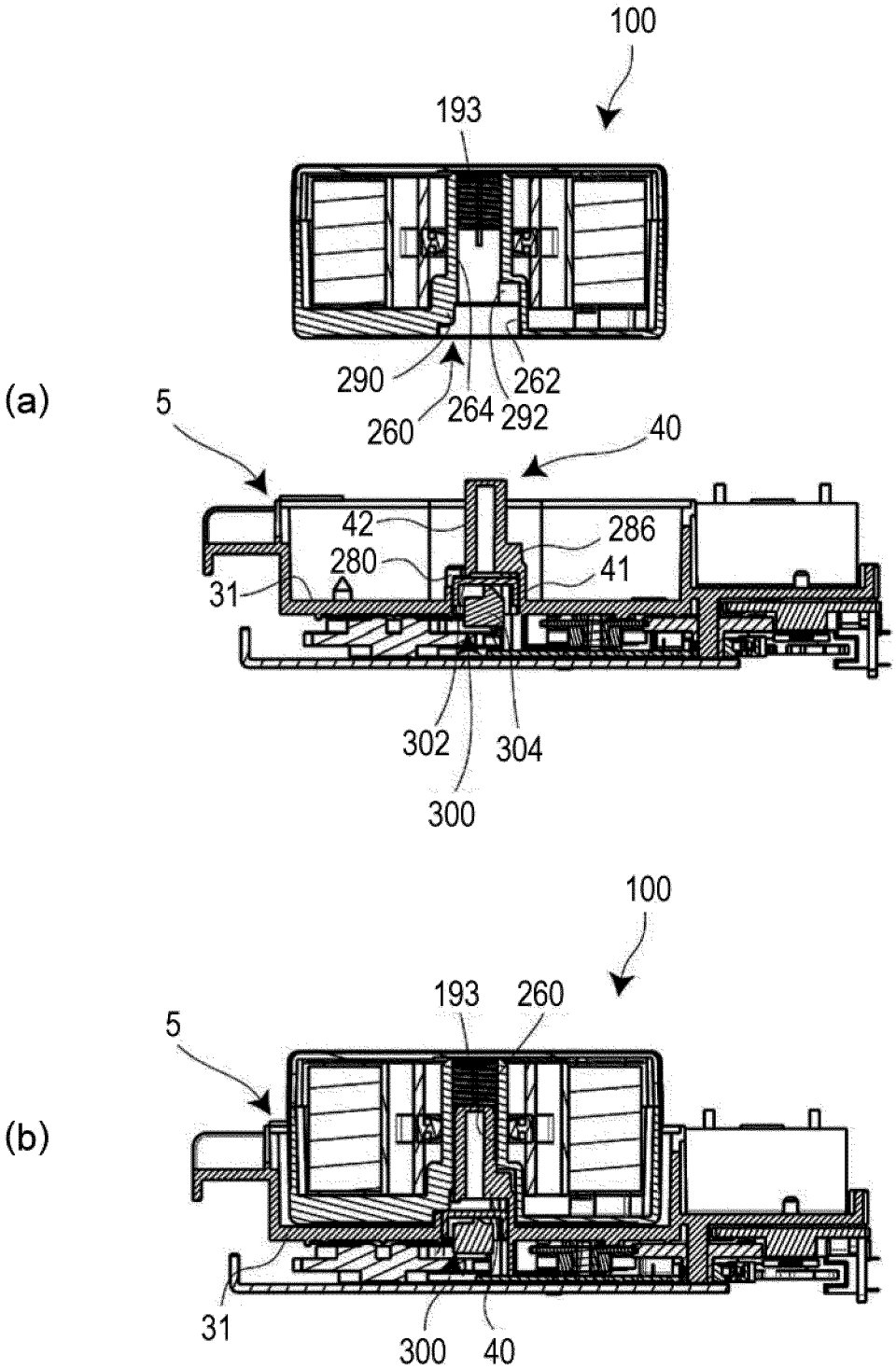
FIG. 14(*a*) is a sectional view of a tape cartridge in a non-mounted state with respect to a cartridge mounting portion and 14(*b*) is a sectional view of the tape cartridge in a mounted state (first modification example).

Next, a first modification example of the embodiment will be described with reference to FIG. 14. As illustrated in the same drawing, in the first modification example, a cartridge detecting portion 300 (operated portion) is incorporated in an inside of a base convex portion 40. The cartridge detecting portion 300 is operated by a fitting convex portion 290 of the core concave portion 260 as an operating portion and detects appropriate mounting of the tape cartridge 100 in the cartridge specification. Therefore, the fitting convex portion 290 in the first modification example also functions as a detected portion on a tape cartridge 100 side.

The cartridge detecting portion 300 has an operated member 302 that is incorporated in an inside of a pedestal portion 41 in a base convex portion 40 and is moved downward by the fitting convex portion 290 that is the operating portion, and a switch body 304 that is in contact with the operated member 302 from below. The switch body 304 is configured of a micro switch which is fixedly provided or the like. In addition, the operated member 302 is formed in a cap shape and is provided on an inner peripheral surface of the pedestal portion 41 so as to be movable up and down.

When the tape cartridge 100 is mounted on the cartridge mounting portion 5, the fitting convex portion 290 of the core concave portion 260 abuts against the operated member 302 via the cutout opening portion 280 of the base convex portion 40 and causes the operated member 302 to move downward. As the operated member 302 moves downward, the switch body 304 is operated (ON) and mounting of the tape cartridge 100 is detected.

As described above, according to the first modification example, the cartridge detecting portion 300 is provided in the base convex portion 40 and thereby it is possible to detect that the tape cartridge 100 is appropriately mounted by the destination region (usage). The cartridge detecting portion 300 has a structure which operates the switch body 304 via the operated member 302 and the operated member 302 is formed in the cap shape. Therefore, even if the position or shape of the cutout opening portion 280 is changed for cartridge identification, it is unnecessary to change the cartridge detecting portion 300 side.

Moreover, in a case where the destination region (usage) such as for cold climate region exists in the tape cartridge 100, the tape printing device 1 may be operated to switch to a cold climate region mode based on a detection result of the cartridge detecting portion 300.

Second Modification Example

Figure 15:
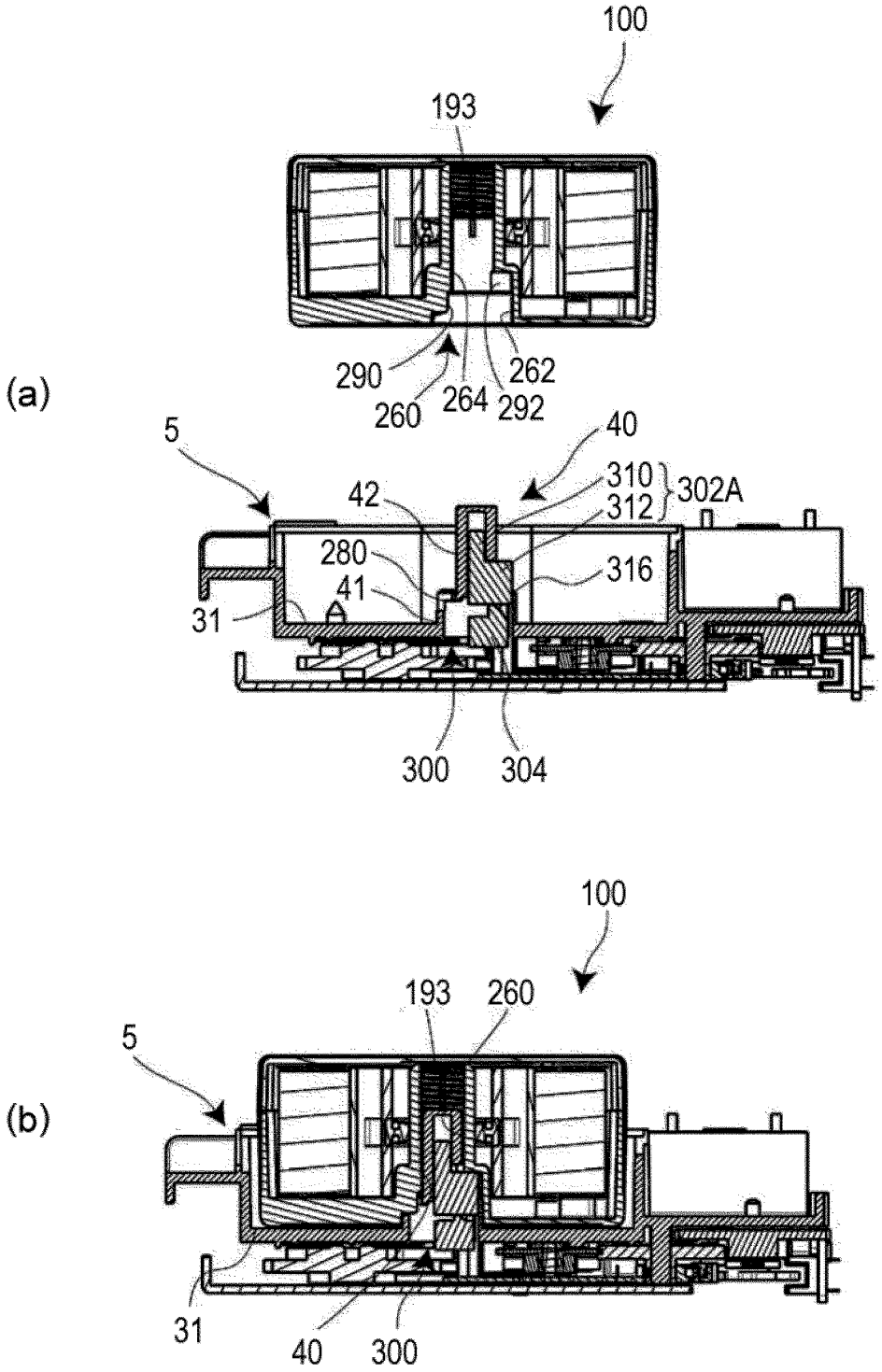
FIG. 15(*a*) is a sectional view of a tape cartridge in a non-mounted state with respect to a cartridge mounting portion and 15(*b*) is a sectional view of the tape cartridge in a mounted state (second modification example).

Next, a second modification example of the embodiment will be described with reference to FIG. 15. As illustrated in the same drawing, in the second modification example, in a cartridge detecting portion 300 incorporated in an inside of a base convex portion 40, an operated member 302A has a structure which also serves as a tongue piece 286. Therefore, in the second modification example, a fitting concave portion 292 of the core concave portion 260 corresponding to the tongue piece 286 functions as a detected portion on a tape cartridge 100 side.

In the cartridge detecting portion 300, the operated member 302A is formed integrally with a shaft-like portion 310 and a tongue-like portion 312 which also serves as the tongue piece 286. The shaft-like portion 310 is provided on an inner peripheral surface of a convex portion body 282 in a base convex portion 40 so as to be movable up and down. In addition, the tongue-like portion 312 is provided in an L-shaped slit portion 316 provided over an upper surface of a pedestal portion 41 from a side surface of the convex portion body 282. In this case, an initial position of the tongue-like portion 312 is set at a position slightly higher than the tongue piece 286 in consideration of an operation stroke.

When the tape cartridge 100 is mounted on the cartridge mounting portion 5, a fitting concave portion 292 (top surface thereof) of a core concave portion 260 abuts against the tongue-like portion 312 of the operated member 302A and moves the operated member 302A downward. As the operated member 302A and moves the operated member 302A downward, a switch body 304 is operated (ON) and mounting of the tape cartridge 100 is detected.

As described above, according to the second modification example, the cartridge detecting portion 300 is provided in the base convex portion 40 and thereby it is possible to detect that the tape cartridge 100 is appropriately mounted by the destination region (usage). In addition, since the operated member 302A has a structure which also serves as the tongue piece 286, it is possible to reduce the number of components.

[Details of Pattern Reading Portion]

Figure 6:
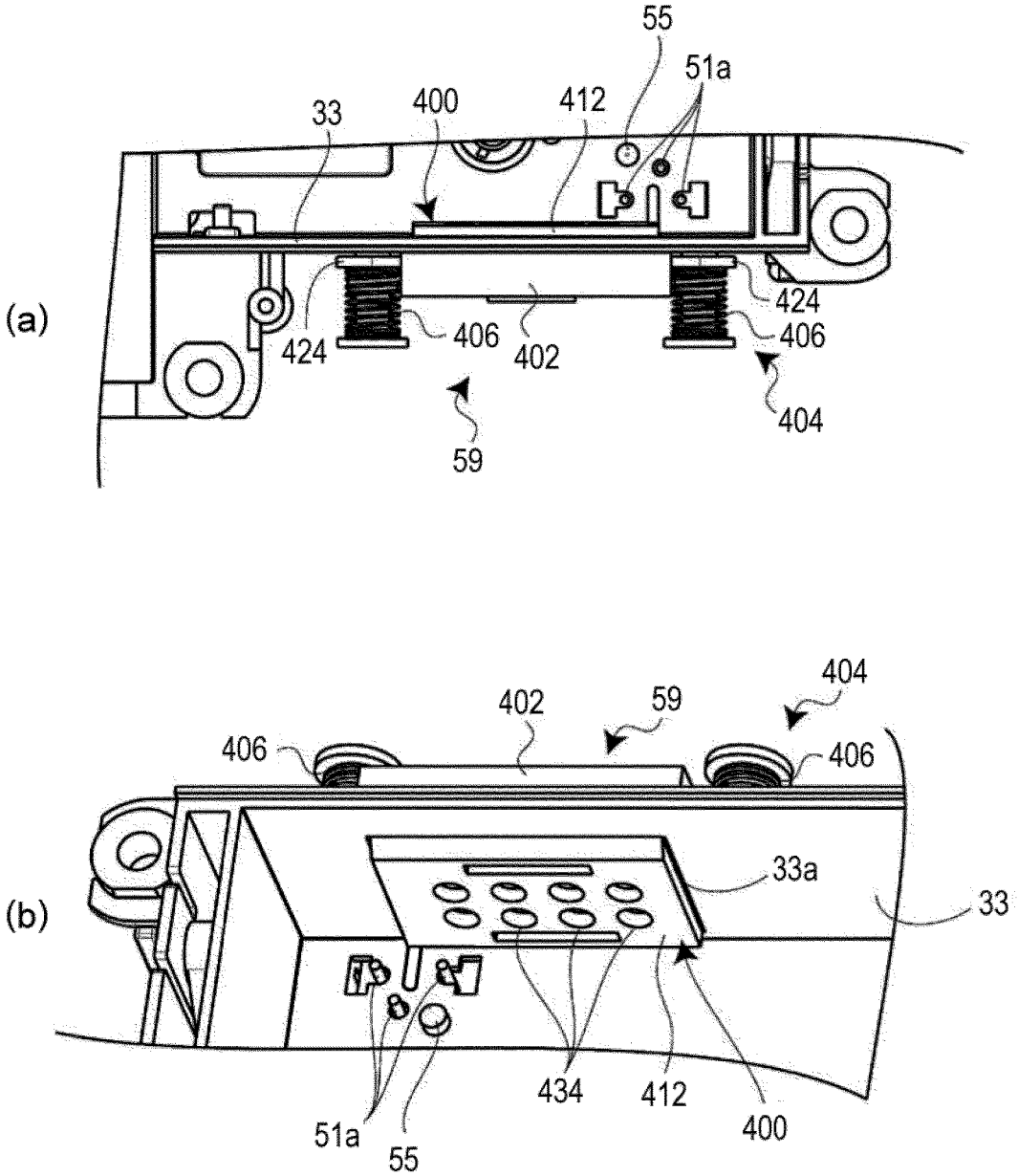
FIG. 6(*a*) is a plan view and 6(*b*) is a perspective view illustrating around a pattern reading portion of the tape printing device.

Next, a pattern reading portion 59 as the detecting portion will be described with reference to FIGS. 5 to 7. As illustrated in FIGS. 5 and 6, the pattern reading portion 59 as a detecting portion is provided in the front side of a side plate portion 33 of a cartridge mounting portion 5 and is disposed toward the inside of the cartridge mounting portion 5. That is, the pattern reading portion 59 is disposed in a position facing a base end surface of the tape cartridge 100 (base end surface 150*a* of the lower case 150) when the tape cartridge 100 is mounted on the cartridge mounting portion 5. The pattern reading portion 59 includes a sensor unit 400 that is disposed toward the inside of the cartridge mounting portion 5, a unit support portion 402 that movably supports the sensor unit 400, and a unit biasing portion 404 that biases the sensor unit 400 toward the inside of the cartridge mounting portion 5.

The unit support portion 402 is provided in an opening portion 33*a* opened to the side plate portion 33 of the cartridge mounting portion 5 and supports the sensor unit 400 to be movable to the inside and the outside of the cartridge mounting portion 5.

The unit biasing portion 404 has a pair of right and left coil springs 406 and biases a pair of spring receiving portions 424 (described below) provided in the sensor unit 400 by the pair of coil springs 406. That is, the unit biasing portion 404 biases the sensor unit 400 into the cartridge mounting portion 5 via the pair of spring receiving portions 424 by the pair of coil springs 406. In a state where the tape cartridge 100 is not mounted, the sensor unit 400 is in a state of protruding toward the cartridge mounting portion 5 by the bias. In addition, in a state where the tape cartridge 100 is mounted, the sensor unit 400 is biased on the tape cartridge 100 side and the sensor unit 400 is in a state of being pressed against the base end surface of the tape cartridge 100.

Figure 7:
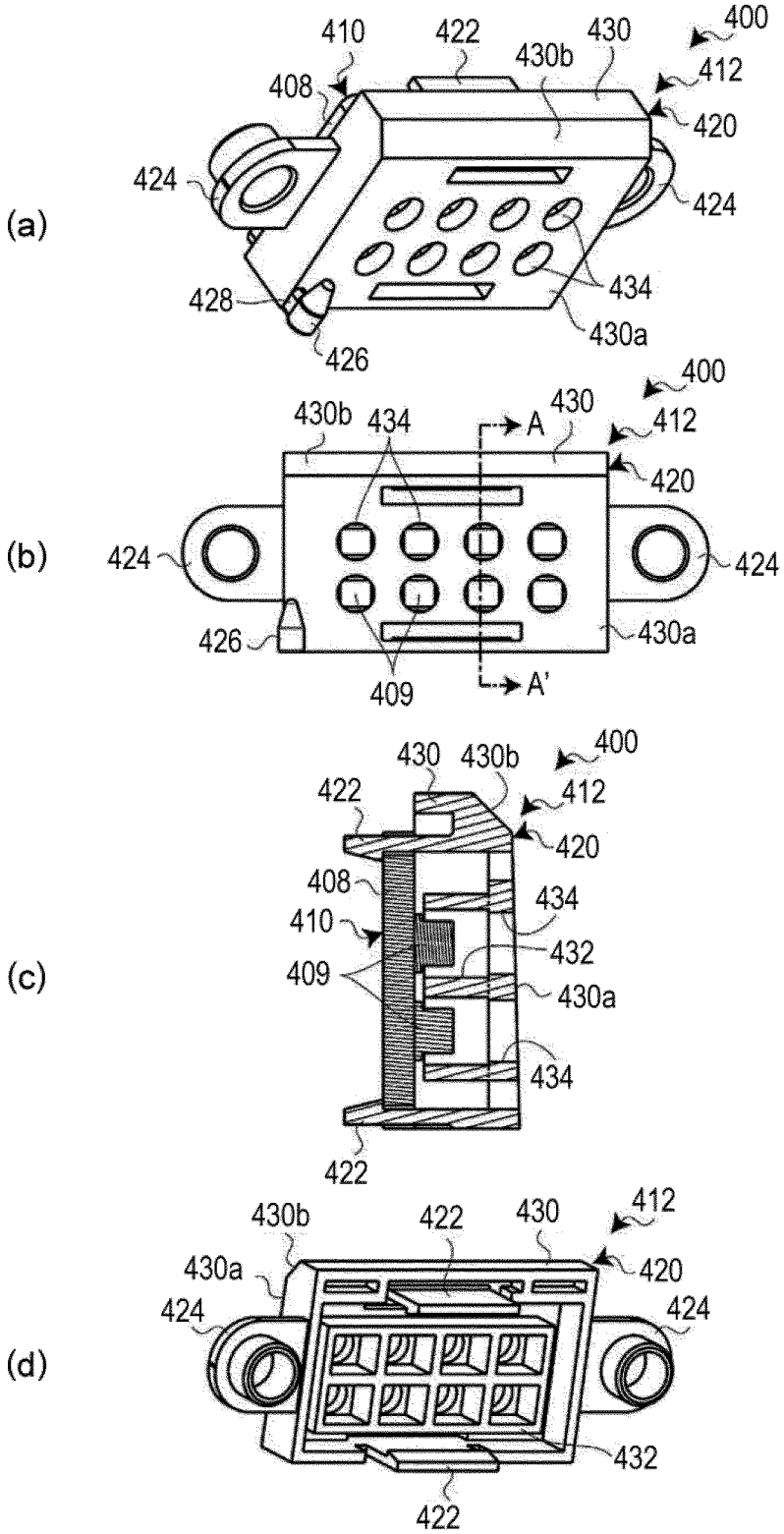
FIG. 7(*a*) is a perspective view, 7(*b*) is a front view, and 7(*c*) is a sectional view that is taken along line A-A' of a sensor unit of the tape printing device, and 7(*d*) is a perspective view of a rear surface of a sensor holder.

As illustrated in FIG. 7, the sensor unit 400 includes a sensor portion 410 (detecting portion) where a plurality of optical sensors 409 are mounted on a sensor substrate 408 and a sensor holder 412 (holder) on which the sensor portion 410 is mounted. The sensor substrate 408 is mounted on a base end portion of the sensor holder 412 in a vertical posture. As described above, the sensor substrate 408 is mounted on the sensor holder 412 and thereby the sensor holder 412 is in a state of holding the sensor portion 410.

The plurality of optical sensors 409 are arranged on the sensor substrate 408 in a matrix form of two rows and four columns (see FIG. 7(*b*)) similar to the bit configuration portion 145 (see FIG. 3). In addition, the plurality of optical sensors 409 are respectively configured of a light reflection type optical non-contact sensor, applies detection light to each bit configuration portion 145 (identification portion 147), and receives reflection light from each bit configuration portion 145 (identification portion 147). As described above, the identification portion 147 displays bit information by whether or not black ink is printed in the white printing region in each bit configuration portion 145. Each optical sensor 409 detects whether or not black ink of the identification portion 147 is printed in the bit configuration portion 145 (whether or not the identification portion 147 is provided) by the presence or absence (strictly speaking, whether or not a light amount is equal to or greater than a certain amount) of the reflection light from each bit configuration portion 145 (identification portion 147). The bit information displayed by each bit configuration portion 145 is read based on the detection result. The sensor portion 410 reads the bit information of each bit configuration portion 145 by the plurality of optical sensors 409. Therefore, the bit pattern is read and the specification information of the tape cartridge 100 corresponding thereto is read.

The sensor holder 412 includes a holder body 420 having a trapezoidal shape in a side view, a pair of upper and lower substrate mounting hooks 422 protruding from the holder body 420 on the base end side, a pair of right and left spring receiving portions 424 protruding from the base end portion of the holder body 420 on right and left sides, a positioning pin 426 (engaged portion) provided on a right front side of the holder body 420, and a connection portion 428 connecting the positioning pin 426 and the holder body 420. Moreover, the holder body 420, the pair of substrate mounting hooks 422, the pair of spring receiving portions 424, the positioning pin 426, and the connection portion 428 are integrally formed (molded) of resin and the like.

The pair of substrate mounting hooks 422 mounts the sensor substrate 408 on the sensor holder 412. That is, the sensor substrate 408 is mounted on the sensor holder 412 by the pair of substrate mounting hook 422.

The pair of spring receiving portions 424 is portions against which one end of the pair of coil springs 406 abuts and which receives a biasing force of the pair of coil springs 406. The pair of spring receiving portions 424 abuts against the side plate portion 33 of the cartridge mounting portion 5 and also functions as a front end regulation portion for performing regulation of the front end in the movement of the sensor unit 400.

The holder body 420 is configured of a holder cover 430 that covers an entirety of the plurality of optical sensors 409 and partition members 432 that individually surround each optical sensor 409. A plurality of sensor holes 434 corresponding to the plurality of optical sensors 409 are formed in a leading end portion of the holder cover 430. Each optical sensor 409 applies the detection light from each sensor hole 434 and receives the reflection light from each bit configuration portion 145 from each sensor hole 434.

The holder cover 430 functions as an external light shielding portion for shielding external light toward each optical sensor 409. On the other hand, the partition member 432 functions as an interference preventing portion for shielding the detection light from the adjacent optical sensors 409 and preventing interference between the optical sensors 409.

In addition, the holder cover 430 also functions as a spacer that abuts against the base end surface of the tape cartridge 100 and causes clearance between the sensor portion 410 (each optical sensor 409) and the bit configuration portion 145 to be a predetermined clearance in addition to the function of the external light shielding portion. That is, a leading end surface 430*a* of the holder cover 430 becomes an abutting surface against the base end surface of the tape cartridge 100. Then, if the holder cover 430 is pressed by the tape cartridge 100 via the pair of spring receiving portions 424 by bias of the unit biasing portion 404 (pair of coil springs 406), the leading end surface 430*a* abuts against the base end surface of the tape cartridge 100 to come into close contact with the base end surface. Therefore, the predetermined clearance is formed between the sensor portion 410 and the bit configuration portion 145. Moreover, the leading end surface 430*a* of the holder cover 430 is formed to be inclined slightly downward so as to follow the base end surface of the tape cartridge 100.

In addition, a leading inclined surface 430*b* inclined downward on the front side is formed in an upper end portion of the holder cover 430 on the front side. The leading inclined surface 430*b* abuts against an end portion of the tape cartridge 100 on the rear surface side and causes a part (component force) of a force for mounting the tape cartridge 100 to act as a force for pushing the sensor unit 400 back on the outside of the cartridge mounting portion 5 when the tape cartridge 100 is mounted. The sensor unit 400 is pushed back against the unit biasing portion 404 by the leading inclined surface 430*b* in accordance with the mounting of the tape cartridge 100. Therefore, when the mounting of the tape cartridge 100 is completed, the sensor unit 400 is in a state of being pressed against the tape cartridge 100.

[Details of Type Reading Pattern (Bit Configuration Portion)]

Next, the bit configuration portion 145 provided in the specification reading seal 143 as the detected portion and the identification portion 147 configuring the bit pattern (specification reading pattern) formed in the bit configuration portion 145 will be described with reference to FIGS. 16 to 24.

As illustrated in FIG. 16, the bit configuration portion 145 as a region for forming the specification reading pattern indicating the specification information (tape color and the material of the housed printing tape 102, the ribbon color of the housed ink ribbon 110, or the like) of the tape cartridge 100 is formed in the specification reading seal 143. The bit configuration portion 145 has eight region bit1 to region bit8 which are disposed in a matrix form of 2 rows and 4 columns. Thus, the bit pattern (specification reading pattern) in which the identification portion 147 is disposed is configured in the region bit1 to the region bit8. The identification portion 147 indicates bit information of each one bit depending on whether or not the black ink is printed (solid printed) in the white printing region. In other words, it is bit information indicated by binary numbers by plain/solid fill in each of the region bit1 to the region bit8 of the bit configuration portion 145. That is, a total eight identification portions 147 indicate an 8-bit bit pattern (specification reading pattern).

As described above, it is possible to read various kinds of specification information of the tape cartridge 100 by the bit configuration portion 145 including the 8-bit bit pattern (specification reading pattern) and the pattern reading portion 59 (see FIGS. 5 and 6) as the above-described detecting portion without performing scanning reading. That is, it is possible to read various kinds of specification information of the tape cartridge 100 easily and in a short period of time without troubling the hand of a mounter (user).

As an example of the configuration of the bit pattern (specification reading pattern), the next configuration can be exemplified. In the configuration example, bit1 and bit5 are a first column, bit2 and bit6 are a second column, bit3 and bit7 are a third column, and bit4 and bit8 are a fourth column. Thus, 4 kinds of the ribbon colors are identified by the bit pattern of the first column, 16 kinds of the tape colors are identified by the bit patterns of the second column and the fourth column, and 4 kinds of the tape widths are identified by the bit pattern of the third column. As described above, the 8-bit bit pattern (specification reading pattern) corresponds to the various kinds of type information and the various kinds of specification information are indicated by the bit pattern.

Moreover, as in the configuration example, even if a positional shift of the pattern reading portion 59 or the like occurs, each thereof is different specification information, and thereby it is possible to reduce erroneous determination and to correctly determine the specification information by avoiding using adjacent columns such as the first column and the second column, and the second column and the third column as the same specification information.

As a combination example (bit pattern) of arrangement of the identification portions 147 in the bit configuration portion 145, as described above, it is possible to have the 8-bit bit pattern (specification reading pattern). Here, the combination examples (bit pattern) of the arrangement of the identification portions 147 are concretely listed in FIGS. 17 to 24. 256 kinds of patterns from a pattern A0 (see FIG. 17) to a pattern P15 (see FIG. 24) can be provided. An arbitrary pattern can be selected from the 256 kinds of patterns and can be used as the specification information of the tape cartridge 100.

Moreover, for the sake of convenience of description, a broken line indicating an outer edge of the bit configuration portion 145 in FIG. 16 is illustrated to indicate the region of the bit configuration portion 145 and may not be actually formed, and instead of the broken line, other line types such as a solid line may be used.

[Modification Example of Identification Portion]

Figure 25:
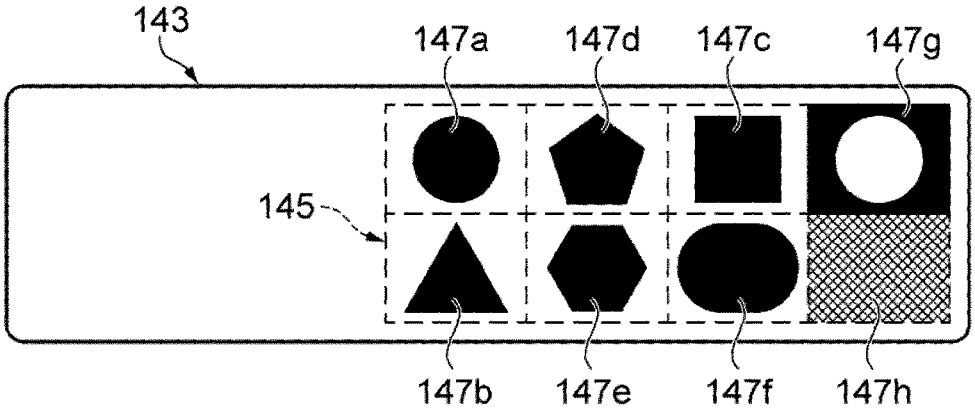
FIG. 25 is a plan view illustrating a modification example of an identification portion.

Next, a modification example of the identification portion will be described with reference to FIG. 25. In the above description, as the identification portion 147, a configuration, in which the black ink is printed (solid printed) in the entirety of the regions (region bit1 to the region bit8) of each of the bit configuration portions 145, is exemplified, but the identification portion 147 is not limited to the configuration. As illustrated in FIG. 25, as the identification portion 147, for example, a configuration capable of being distinguished from the white bit configuration portion 145 such as a circular identification portion 147*a* printed (solid printed) with black ink, a triangle identification portion 147*b* printed (solid printed) with black ink, a quadrangular identification portion 147*c* printed (solid printed) with black ink, a pentagon identification portion 147*d* printed (solid printed) with black ink, a hexagonal identification portion 147*e* printed (solid printed) with black ink, or an elliptical shaped (track shaped) identification portion 147*f* printed (solid printed) with black ink. Moreover, the identification portion 147 is not limited to the above-described modification example and a configuration, which is capable of being distinguished from the bit configuration portion 145 in which the identification portion 147 is not provided such as another polygon and an ellipse, or a shape having an outer shape combining a linear portion and a curved portion, can be applied. In addition, as illustrated in FIG. 25, it is possible to apply to another configuration example of the identification portion 147, for example, as long as it is a configuration capable of being distinguished from the bit configuration portion 145, in which the identification portion 147 is not provided, such as a lattice-patterned identification portion 147*h* configured of a plurality of intersecting straight lines, or an identification portion 147*g* provided with a hollow circle in a black character.

According to the above-described embodiment, the tape cartridge 100 is mounted by spline-engaging between the spline boss portion 244 as the fitting portion of the tape cartridge 100 and the spline driving shaft 49 (driving shaft) of the platen driving shaft 45 of the tape printing device 1. The tape cartridge 100 and the holder (cartridge mounting portion 5) are integrated by mounting the tape cartridge 100 as described above, and the position of the pattern reading portion 59 as the detecting portion is positioned with respect to the position of the specification reading seal 143 (bit configuration portion 145) as the detected portion. Therefore, a positional relationship between the pattern reading portion 59 and the specification reading seal 143 (bit configuration portion 145) can be an optimal positional relationship.

In addition, in a case where the tape cartridge 100 is mounted, the pattern reading portion 59 as the detecting portion is disposed so as to face the specification reading seal 143 (bit configuration portion 145) as the detected portion disposed on the wall surface following the mounting direction of the tape cartridge 100. Therefore, it is possible to shorten the distance between the pattern reading portion 59 and the specification reading seal 143 (bit configuration portion 145), and to be unlikely to receive an influence of the positional shift between the tape cartridge and the holder. That is, it is possible to maintain the optimal positional relationship between the pattern reading portion 59 and the specification reading seal 143 (bit configuration portion 145). As described above, it is possible to make the positional relationship between the pattern reading portion 59 and the specification reading seal 143 (bit configuration portion 145) the optimal positional relationship and to maintain the optimal positional relationship. Therefore, it is possible to improve a detection ability by the pattern reading portion 59 and to accurately read the specification information of the tape cartridge.

In addition, in the embodiment described above, each of the bit configuration portion 145 and the optical sensor 409 includes eight of two rows and four columns, but the number and arrangement (the number of rows and the number of columns) thereof are not limited to the embodiment. For example, each of the bit configuration portion 145 and the optical sensor 409 may be horizontally arranged side by side as six of one row and six columns or may be vertically arranged side by side as six of six rows and one column. In addition, the number of rows and the number of columns may be the same as each other as sixteen of four rows and four columns.

In addition, in the above-described embodiment, the bit configuration portion 145 displays the bit information of one bit by whether or not black ink is printed (solid printed) in a white printing region, but the color of the printing region and the color of ink to be printed are not limited to the embodiment if the bit information can be detected by the optical sensor 409 (if presence or absence and intensity of the reflection light can be detected when being irradiated with the detection light). For example, bit information of one bit may be displayed by whether or not white ink is printed in a black printing region. In addition, for example, one of the color of the printing region and the color of ink may be a color of blue, navy blue, and a greenish color, and the other may be red, yellow, and orange.

Furthermore, in the above-described embodiment, the specification reading seal 143 as the detected portion, on which the bit pattern (specification reading pattern) is formed where the identification portion 147 is disposed in the bit configuration portion 145, is adhered to the side surface (base end surface 150*a*) of the tape cartridge 100 and the bit configuration portion 145 is provided on the side surface (base end surface 150*a*) of the tape cartridge 100, but the bit configuration portion 145 may be directly formed on the side surface (base end surface 150*a*) of the tape cartridge 100. In such a case, the bit pattern (specification reading pattern) may be printed (imaged) on the side surface by the bit configuration portion 145 in which the identification portion 147 is disposed or the bit pattern (specification reading pattern) may be engraved (imaged) on the side surface by a laser and the like by the bit configuration portion 145 in which the identification portion 147 is disposed. Furthermore, an opening is selectively formed with respect to each identification portion 147 and thereby the bit pattern (specification reading pattern) may be formed (imaged) by the bit configuration portion 145 in which the identification portion 147 is disposed.

CROSS REFERENCE TO RELATED APPLICATIONS

This application claims priority to PCT Patent Application No. PCT/JP2015/001909 filed on Apr. 3, 2015, the entire contents of which are incorporated by reference herein.

The invention claimed is:

1. A tape cartridge that is attached or detached in an attaching and detaching direction to or from a tape printing device including a detecting portion for reading specification information of the tape cartridge from a detected portion by irradiating the detected portion disposed in the tape cartridge with detection light, a cartridge mounting portion, a holder on which the detecting portion is mounted, and a biasing portion that biases the holder toward an inside of the cartridge mounting portion, the tape cartridge comprising:

a cartridge case having a tape housing area in which a printing tape is housed;

wherein:

the detected portion is disposed on a periphery wall portion of the cartridge case at an opposite side of the tape housing area; and a concave portion is disposed from a wall surface on a rear side in a mounting direction toward an inside of the tape housing area, the detected portion has a bit configuration portion disposed in a matrix form of 2 rows and 4 columns, and constitutes the specification information by a combination of identification portions disposed in the bit configuration portion, and wherein, when the tape cartridge is mounted on the cartridge mounting portion, the holder is biased toward a side of the tape cartridge, and the holder is pressed against the periphery wall portion of the cartridge case that includes the detected portion.

2. The tape cartridge according to claim 1, wherein an adhering portion is concavely provided on the periphery wall portion, and the detected portion is adhered on the adhering portion.

3. The tape cartridge according to claim 1, wherein the detected portion is drawn on the periphery wall portion.

4. The tape cartridge according to claim 1, wherein an outer edge of each of the identification portions of the bit configuration portion is one of a solid line or a broken line.

5. The tape cartridge according to claim 1, wherein a shape of the identification portion is a circle, an ellipse, a polygon, or a shape combining a linear portion and a curved portion.

6. The tape cartridge according to claim 1, wherein the adjacent columns within the bit configuration portion have different specification information each other.

* * * * *